US009460664B2

(12) United States Patent
Kimura

(10) Patent No.: US 9,460,664 B2
(45) Date of Patent: Oct. 4, 2016

(54) DISPLAY APPARATUS WITH COMPENSATION FOR BRIGHTNESS-INSUFFICIENT LIGHT SOURCE, AND CONTROL METHOD THEREFOR

(71) Applicant: CANON KABUSHIKI KAISHA, Tokyo (JP)

(72) Inventor: Takushi Kimura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 14/523,116

(22) Filed: Oct. 24, 2014

(65) Prior Publication Data

US 2015/0116376 A1 Apr. 30, 2015

(30) Foreign Application Priority Data

Oct. 31, 2013 (JP) ..... 2013-226979
May 29, 2014 (JP) ..... 2014-111628

(51) Int. Cl.
*G09G 3/34* (2006.01)

(52) U.S. Cl.
CPC ..... *G09G 3/3406* (2013.01); *G09G 2320/043* (2013.01); *G09G 2320/0646* (2013.01); *G09G 2360/144* (2013.01); *G09G 2360/16* (2013.01)

(58) Field of Classification Search
CPC ..... G09G 3/3406; G09G 2320/0646; G09G 2360/144; G09G 2360/16; G09G 3/3426; G09G 2320/0242; G09G 2320/04–2320/048
USPC ..... 345/690
See application file for complete search history.

(56) References Cited

U.S. PATENT DOCUMENTS 7,511,853 B2 3/2009 Nakami
7,646,405 B2 1/2010 Nakami
8,203,755 B2 6/2012 Nakami
9,161,408 B2 * 10/2015 Messmer ..... G09G 3/3426
2003/0063053 A1 * 4/2003 Yamazaki ..... G09G 3/3241 345/82
2007/0146385 A1 * 6/2007 Kienhoefer ..... G09G 3/22 345/593
2010/0085445 A1 4/2010 Nakami
2010/0253706 A1 * 10/2010 Shirouzu ..... G09G 3/2092 345/690
2011/0007055 A1 * 1/2011 Wang ..... G09G 3/3426 345/211
2011/0007104 A1 * 1/2011 Nakazawa ..... G09G 3/3413 345/690
2011/0128305 A1 * 6/2011 Shimizu ..... G09G 3/3406 345/690

FOREIGN PATENT DOCUMENTS

JP 2002-099250 A 4/2002
WO 2004/008755 A1 1/2004

* cited by examiner

*Primary Examiner* — Larry Sternbane

(74) *Attorney, Agent, or Firm* — Fitzpatrick, Cella, Harper & Scinto

(57) ABSTRACT

A display apparatus includes: a light emitting unit having a plurality of light sources; a display unit; a determination unit configured to determine, for each light source, a target brightness on the basis of a display image data in region corresponding to the light source; and a control unit configured to control the emission brightness of each light source to the target brightness, wherein when a brightness-insufficient light source is present, the determination unit adjusts the target brightness of light sources around the brightness-insufficient light source, to a value higher than a value corresponding to the display image data in regions corresponding to the light sources around the brightness-insufficient light source.

16 Claims, 24 Drawing Sheets

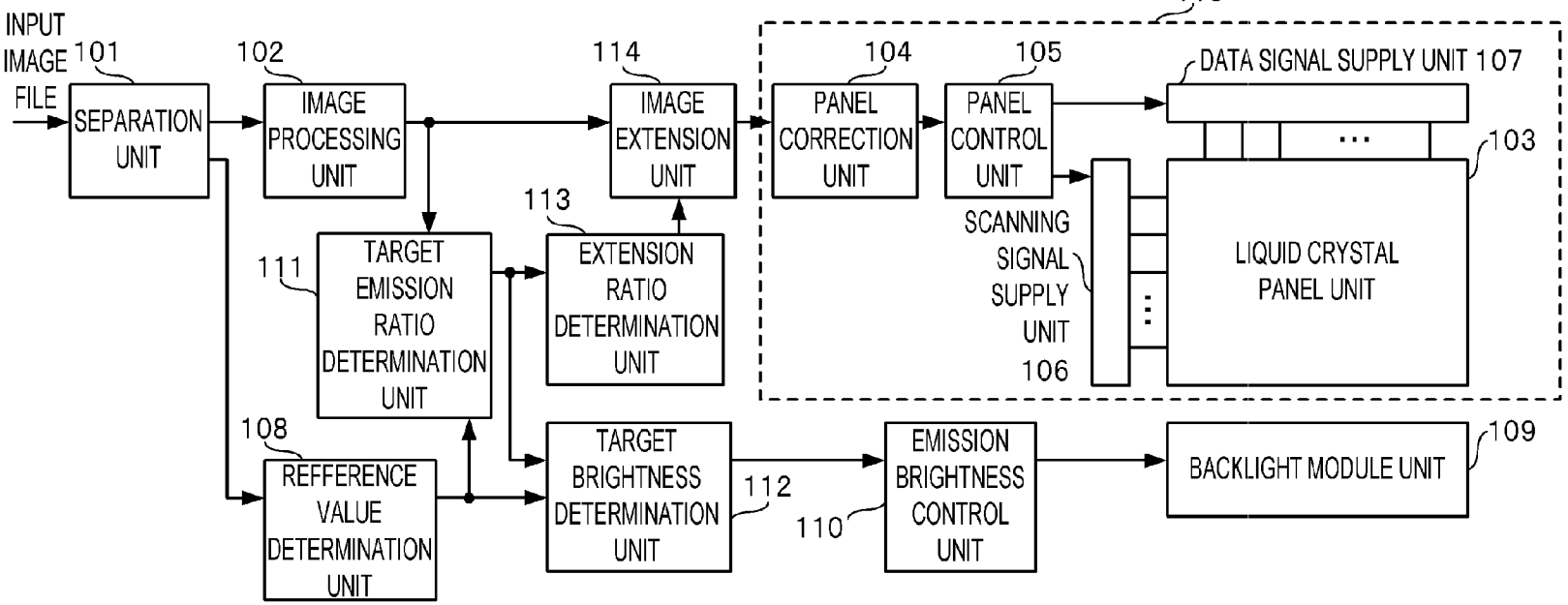
FIG. 1
INPUT IMAGE FILE
101
SEPARATION UNIT
102
IMAGE PROCESSING UNIT
114
IMAGE EXTENSION UNIT
104
PANEL CORRECTION UNIT
105
PANEL CONTROL UNIT
115
DATA SIGNAL SUPPLY UNIT 107
103
LIQUID CRYSTAL PANEL UNIT
SCANNING SIGNAL SUPPLY UNIT 106
111
TARGET EMISSION RATIO DETERMINATION UNIT
113
EXTENSION RATIO DETERMINATION UNIT
108
REFFERENCE VALUE DETERMINATION UNIT
112
TARGET BRIGHTNESS DETERMINATION UNIT
110
EMISSION BRIGHTNESS CONTROL UNIT
109
BACKLIGHT MODULE UNIT FIG. 2A
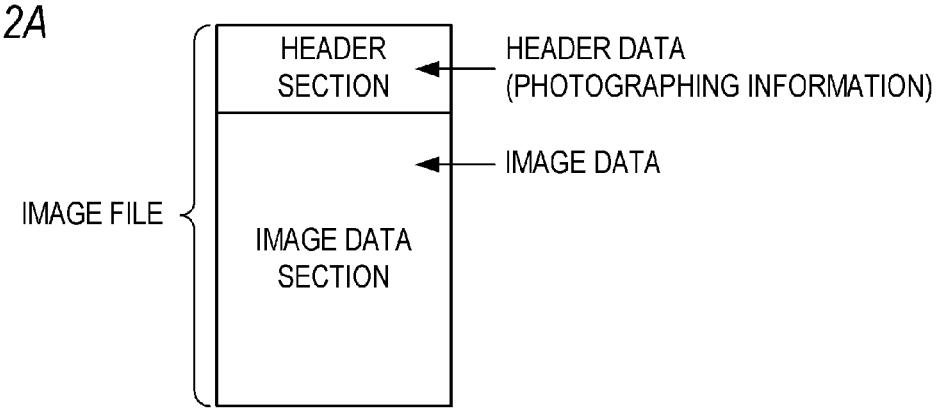
FIG. 2B
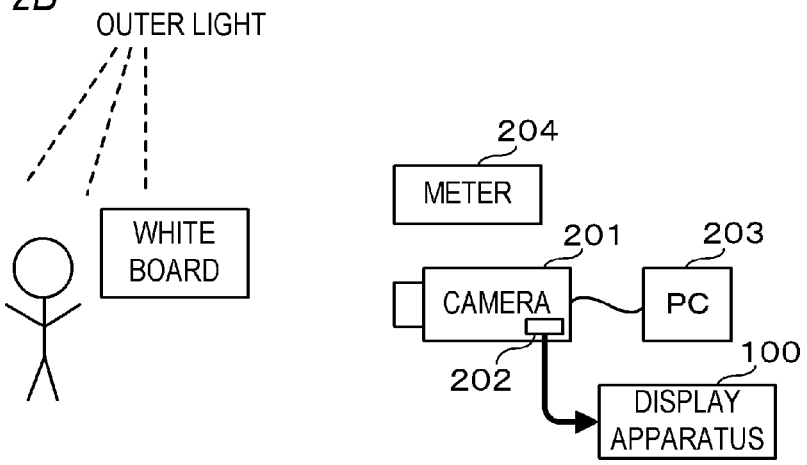
FIG. 2C
| attribute name | attribute type | attribute size | attribute value |
|---|---|---|---|
| white luminance 0 | int 0 | 4 | 100000 |

FIG. 7A

PRE-ADJUSTMENT RATIO

| | | | | | |
|---|---|---|---|---|---|
| 0 | 0 | 0 | 0 | 0 | 0 |
| 0 | 0 | 0 | 0 | 0 | 0 |
| 0 | 0 | 1 | 0 | 0 | 0 |
| 0 | 0 | 0 | 0 | 0 | 0 |
| 0 | 0 | 0 | 0 | 0 | 0 |

TARGET BRIGHTNESS REFERENCE VALUE (ADJUSTED EMISSION RATIO)

200[cd/m²] (0) →

POST-ADJUSTMENT RATIO

| | | | | | |
|---|---|---|---|---|---|
| 0 | 0 | 0 | 0 | 0 | 0 |
| 0 | 0 | 0 | 0 | 0 | 0 |
| 0 | 0 | 1 | 0 | 0 | 0 |
| 0 | 0 | 0 | 0 | 0 | 0 |
| 0 | 0 | 0 | 0 | 0 | 0 |

1500[cd/m²] (0.3) →

| | | | | | |
|---|---|---|---|---|---|
| 0 | 0 | 0 | 0 | 0 | 0 |
| 0 | 0.3 | 0.3 | 0.3 | 0 | 0 |
| 0 | 0.3 | 1 | 0.3 | 0 | 0 |
| 0 | 0.3 | 0.3 | 0.3 | 0 | 0 |
| 0 | 0 | 0 | 0 | 0 | 0 |

FIG. 7B

PRE-ADJUSTMENT RATIO

| | | | | | |
|---|---|---|---|---|---|
| 0.5 | 0.5 | 0.2 | 0 | 0 | 0 |
| 0.5 | 0.5 | 0.2 | 0 | 0.2 | 0 |
| 0.5 | 0.5 | 1 | 0 | 0 | 0 |
| 0.5 | 0.5 | 0.2 | 0 | 0 | 0 |
| 0.5 | 0.5 | 0.2 | 0 | 0 | 0 |

TARGET BRIGHTNESS REFERENCE VALUE (ADJUSTED EMISSION RATIO)

1500[cd/m²] (0.3) →

POST-ADJUSTMENT RATIO

| | | | | | |
|---|---|---|---|---|---|
| 0.5 | 0.5 | 0.2 | 0 | 0 | 0 |
| 0.5 | 0.5 | 0.3 | 0.3 | 0.2 | 0 |
| 0.5 | 0.5 | 1 | 0.3 | 0 | 0 |
| 0.5 | 0.5 | 0.3 | 0.3 | 0 | 0 |
| 0.5 | 0.5 | 0.2 | 0 | 0 | 0 |

FIG. 7C

PRE-ADJUSTMENT RATIO

| | | | | | |
|---|---|---|---|---|---|
| 0 | 0 | 0 | 0 | 0 | 0 |
| 0 | 0 | 0 | 0 | 0 | 0 |
| 0 | 0 | 1 | 1 | 0 | 0 |
| 0 | 0 | 0 | 0 | 0 | 0 |
| 0 | 0 | 0 | 0 | 0 | 0 |

TARGET BRIGHTNESS REFERENCE VALUE (ADJUSTED EMISSION RATIO)

1500[cd/m²] (0.3) →

POST-ADJUSTMENT RATIO

| | | | | | |
|---|---|---|---|---|---|
| 0 | 0 | 0 | 0 | 0 | 0 |
| 0 | 0.3 | 0.3 | 0.3 | 0.3 | 0 |
| 0 | 0.3 | 1 | 1 | 0.3 | 0 |
| 0 | 0.3 | 0.3 | 0.3 | 0.3 | 0 |
| 0 | 0 | 0 | 0 | 0 | 0 |

FIG. 14

| | EMBODIMENT 2 | EMBODIMENT 3 |
|---|---|---|
| DISPLAY IMAGE DATA BEFORE EXTENSION (DESTRIBUTION OF PIXEL VALUE IN HORIZONTAL DIRECTION) | MAXIMUM VALUE<br>0 | |
| TARGET BRIGHTNESS REFERENCE VALUE | 1000 [cd/m²] | |
| UPPER LIMIT VALUE OF EMISSION BRIGHTNESS | 700 [cd/m²] | |
| TARGET EMISSION RATIO | 1 | 0.7 (=700/1000) |
| EMISSION BRIGHTNESS | 700 [cd/m²] | 700 [cd/m²] |
| EXTENSION RATIO | 1 | 1.4 (=1/0.7) |
| DISPLAY IMAGE DATA AFTER EXTENSION | | LIMITATION |
| DISPLAY BRIGHTNESS | INSUFFICIENT BRIGHTNESS | BRIGHTNESS INCREASE |

*FIG. 23A*

BRIGHTNESS DISTRIBUTION DATA

| | | | | |
|---|---|---|---|---|
| 0 | 0.02 | 0.03 | 0.02 | 0 |
| 0.02 | 0.05 | 0.06 | 0.05 | 0.02 |
| 0.03 | 0.06 | 0.31 | 0.06 | 0.03 |
| 0.02 | 0.05 | 0.06 | 0.05 | 0.02 |
| 0 | 0.02 | 0.03 | 0.04 | 0 |

*FIG. 23B*

FIRST TARGET BRIGHTNESS RATIO

| | | | | | |
|---|---|---|---|---|---|
| 0 | 0 | 0 | 0 | 0 | 0 |
| 0 | 0 | 0 | 0 | 0 | 0 |
| 0 | 0 | 1 | 0.7 | 0 | 0 |
| 0 | 0 | 0 | 0 | 0 | 0 |
| 0 | 0 | 0 | 0 | 0 | 0 |

*FIG. 23C*

COMBINED BRIGHTNESS RATIO

| | | | | | |
|---|---|---|---|---|---|
| 0 | 0.02 | 0.04 | 0.04 | 0.01 | 0 |
| 0.02 | 0.06 | 0.10 | 0.09 | 0.06 | 0.01 |
| 0.03 | 0.08 | 0.35 | 0.28 | 0.07 | 0.02 |
| 0.02 | 0.06 | 0.10 | 0.09 | 0.06 | 0.01 |
| 0 | 0.02 | 0.04 | 0.04 | 0.01 | 0 |

*FIG. 23D*

BRIGHTNESS RATIO DIFFERENCE

| | | | | | |
|---|---|---|---|---|---|
| 0 | 0 | 0 | 0 | 0 | 0 |
| 0 | 0 | 0 | 0 | 0 | 0 |
| 0 | 0 | 0.65 | 0.42 | 0 | 0 |
| 0 | 0 | 0 | 0 | 0 | 0 |
| 0 | 0 | 0 | 0 | 0 | 0 |

*FIG. 23E*

BRIGHTNESS RATIO CORRECTION VALUE

| | | | | | |
|---|---|---|---|---|---|
| 0 | 0 | 0 | 0 | 0 | 0 |
| 0 | 0 | 0 | 0 | 0 | 0 |
| 0 | 0 | 2.10 | 1.35 | 0 | 0 |
| 0 | 0 | 0 | 0 | 0 | 0 |
| 0 | 0 | 0 | 0 | 0 | 0 |

FIG. 23F

SECOND TARGET BRIGHTNESS RATIO

| | | | | | |
|---|---|---|---|---|---|
| 0 | 0 | 0 | 0 | 0 | 0 |
| 0 | 0 | 0 | 0 | 0 | 0 |
| 0 | 0 | 3.10 | 2.05 | 0 | 0 |
| 0 | 0 | 0 | 0 | 0 | 0 |
| 0 | 0 | 0 | 0 | 0 | 0 |

FIG. 23G

INSUFFICIENT BRIGHTNESS RATIO

| | | | | | |
|---|---|---|---|---|---|
| 0 | 0 | 0 | 0 | 0 | 0 |
| 0 | 0 | 0 | 0 | 0 | 0 |
| 0 | 0 | 0.60 | 0 | 0 | 0 |
| 0 | 0 | 0 | 0 | 0 | 0 |
| 0 | 0 | 0 | 0 | 0 | 0 |

FIG. 23H

EXPANDED EMISSION RATIO

| | | | | | |
|---|---|---|---|---|---|
| 0 | 0 | 0 | 0 | 0 | 0 |
| 0 | 0.42 | 0.42 | 0.42 | 0 | 0 |
| 0 | 0.42 | 0 | 0.42 | 0 | 0 |
| 0 | 0.42 | 0.42 | 0.42 | 0 | 0 |
| 0 | 0 | 0 | 0 | 0 | 0 |

FIG. 23I

THIRD TARGET BRIGHTNESS RATIO

| | | | | | |
|---|---|---|---|---|---|
| 0 | 0 | 0 | 0 | 0 | 0 |
| 0 | 0.42 | 0.42 | 0.42 | 0 | 0 |
| 0 | 0.42 | 2.50 | 2.05 | 0 | 0 |
| 0 | 0.42 | 0.42 | 0.42 | 0 | 0 |
| 0 | 0 | 0 | 0 | 0 | 0 |

DISPLAY APPARATUS WITH COMPENSATION FOR BRIGHTNESS-INSUFFICIENT LIGHT SOURCE, AND CONTROL METHOD THEREFOR

BACKGROUND OF THE INVENTION

1. Field of the Invention

The present invention relates to a display apparatus and a control method therefore.

2. Description of the Related Art

The technique for adjusting the brightness of a display image (image displayed on a screen) by correcting the pixel values of image data on the basis of information attached to the image data is well known (see, for example, WO 2004/008755).

Another conventional technique relating to liquid crystal display apparatuses involves controlling individually the emission brightness of a plurality of light sources of a backlight on the basis of image data. For example, the technique is known for compensating the variation of display brightness that varies depending on the emission brightness of the light sources by individually controlling the emission brightness of a plurality of light sources on the basis of image data and adjusting the transmittance of liquid crystal elements (see, for example, Japanese Patent Application Publication No. 2002-99250. By using such a technique, it is possible to decrease the black float of the dark portion of the display image and increase the contrast of the display image.

SUMMARY OF THE INVENTION

However, with the technique disclosed in WO 2004/008755, the brightness of the display image is adjusted by correcting the pixel images of image data. Further, there are an upper limit value and a lower limit value for the pixel values. Therefore, the range of brightness in which the adjustment can be performed without generating black defects in a dark portion and white defects in a bright portion is limited to a narrow range. Thus, where the pixel values are corrected such that the black defects in a dark portion and white defects in a bright portion are not generated, the dynamic range of the display image is limited to a low value.

Further, an upper limit value and a lower limit value are also present for the emission brightness of light sources. Therefore, in the technique disclosed in Japanese Patent Application Publication No. 2002-99250, where the emission brightness of light sources is adjusted such that the maximum value of the target brightness of the light sources does not exceed the upper limit value of the emission brightness, the dynamic range of the display image is limited to a low value. Further, where the target brightness of the light sources is determined without taking into account the upper limit value of the emission brightness, alight source can be found in which the target brightness exceeds the upper limit value of the emission brightness. The emission brightness of such a light source is usually limited to an upper limit value. Therefore, the light from the backlight is insufficient and the display brightness decreases in the screen region corresponding to such a light source. Thus, the display brightness becomes uneven.

The present invention provides a technique making it possible to increase the contrast of a display image and obtain a display image with a high dynamic range.

The present invention in its first aspect provides a display apparatus comprising:

a light emitting unit having a plurality of light sources of which emission brightness can be controlled individually;

a display unit configured to display an image on a screen by modulating light from the light emitting unit on the basis of display image data;

a determination unit configured to determine, for each light source, a target emission ratio, which is a ratio of a target brightness of the light source to an upper limit value of the emission brightness, on the basis of a brightness of the display image data in a region corresponding to the light source, and determine, for each light source, the target brightness on the basis of the target emission ratio; and a control unit configured to control the emission brightness of each light source to the target brightness, wherein when a brightness-insufficient light source, for which the target brightness corresponding to the brightness of the display image data in the corresponding region exceeds the upper limit value of the emission brightness, is present among the plurality of light sources, the determination unit adjusts the target brightness of light sources around the brightness-insufficient light source, to a value higher than a value corresponding to the brightness of display image data in regions corresponding to the light sources around the brightness-insufficient light source.

The present invention in its second aspect provides a control method for a display apparatus including:

a light emitting unit having a plurality of light sources of which emission brightness can be controlled individually; and a display unit configured to display an image on a screen by modulating light from the light emitting unit on the basis of display image data, the control method comprising:

determining, for each light source, a target emission ratio, which is a ratio of a target brightness of the light source to an upper limit value of the emission brightness, on the basis of a brightness of the display image data in a region corresponding to the light source, determining, for each light source, the target brightness on the basis of the target emission ratio; and controlling the emission brightness of each light source to the target brightness, wherein in determining the target brightness, when a brightness-insufficient light source, for which the target brightness corresponding to the brightness of the display image data in the corresponding region exceeds the upper limit value of the emission brightness, is present among the plurality of light sources, the target brightness of light sources around the brightness-insufficient light source is adjusted to a value higher than a value corresponding to the brightness of display image data in regions corresponding to the light sources around the brightness-insufficient light source.

The present invention in its third aspect provides a non-transitory computer readable medium that stores a program, wherein the program causes a computer to execute the method.

In accordance with the present invention, the contrast of a display image can be increased and a display image with a high dynamic range can be obtained.

Further features of the present invention will become apparent from the following de script ion of exemplary embodiments with reference to the attached drawings.

BRIEF DESCRIPTION OF THE DRAWINGS

FIG. 1 illustrates an example of the functional configuration of the display apparatus according to Embodiment 1;

FIGS. 2A to 2C illustrate an example of the configuration of the input image file according to Embodiment 1;

FIGS. 7A to 7C illustrate an operation example of the emission area expansion unit according to Embodiment 1;

FIG. 14 illustrates an operation example of the display apparatus according to Embodiment 3;

FIGS. 23A to 23I illustrate an operation example of the target emission ratio determination unit according to Embodiment 7.

DESCRIPTION OF THE EMBODIMENTS

<Embodiment 1>

Figure 3:
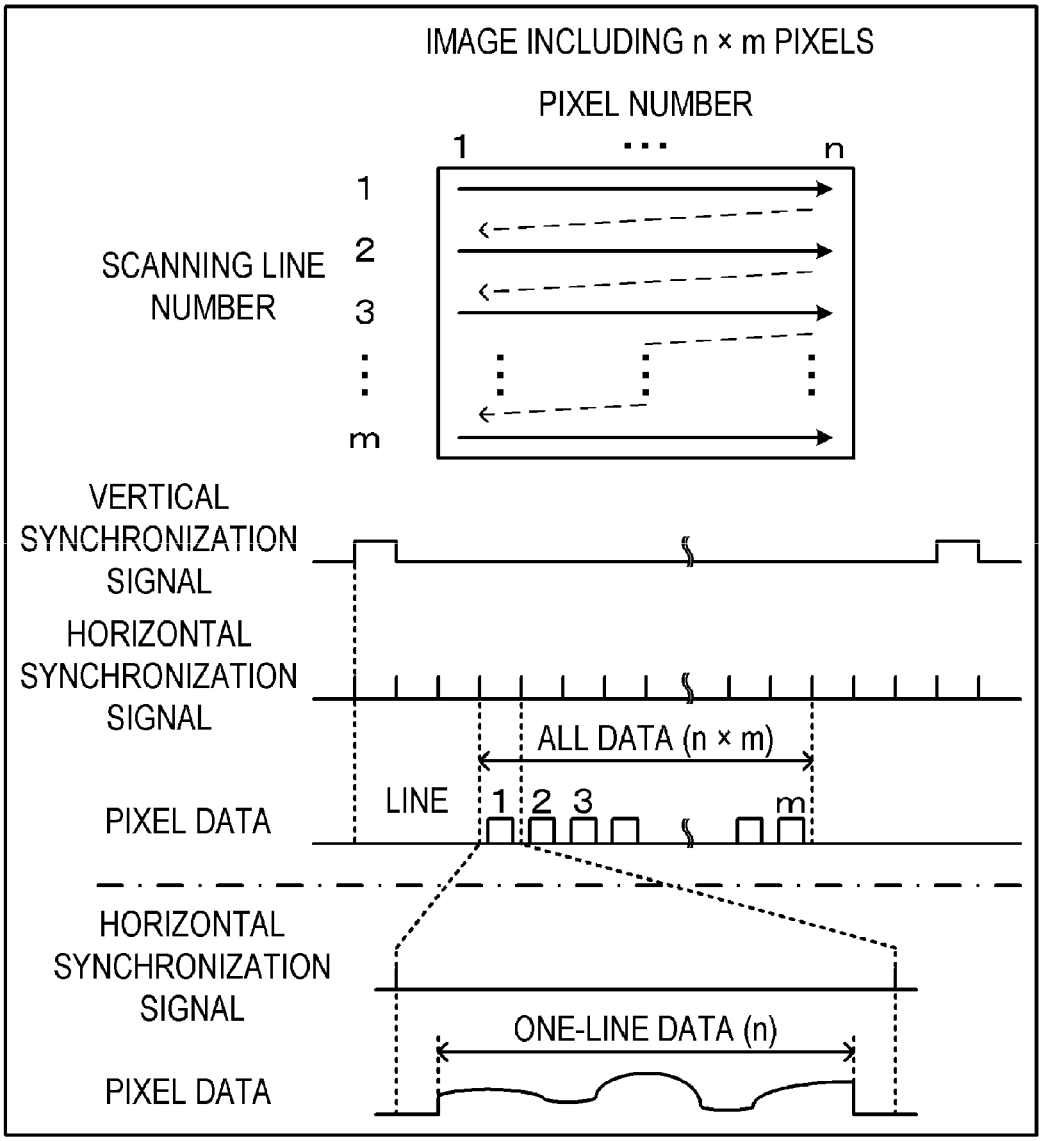
FIG. 3 illustrates an example of the format of image data according to Embodiment 1.

The display apparatus according to Embodiment 1 of the present invention and the control method therefore will be described below with reference to the appended drawings.

In the case explained in the present exemplary embodiment, the display apparatus is a transmission-type liquid crystal display apparatus, but the display apparatus is not limited to the transmission-type liquid crystal display apparatus. Thus, the display apparatus may be any display apparatus having independent light sources. For example, the display apparatus may be a reflection-type liquid crystal display apparatus, a liquid crystal projector which projects an image on a screen, and the like. The display apparatus may also use other elements capable of controlling the transmittance of light from a backlight, instead of the liquid crystal elements. For example, the display apparatus may be a micro electro mechanical system (MEMS) shutter-system display using a MEMS shutter instead of the liquid crystal elements.

FIG. 1 is a block diagram illustrating an exemplary embodiment of the functional configuration of the display apparatus according to the present example.

The display apparatus according to the present exemplary embodiment has, for example, a separation unit 101, an image processing unit 102, a display unit 115, a reference value determination unit 108, a backlight module unit 109, an emission brightness control unit 110, a target emission ratio determination unit 111, a target brightness determination unit 112, an extension rate determination unit 113, and an image extension unit 114. The display unit 115 has, for example, a liquid crystal panel unit 103, a panel correction unit 104, a panel control unit 105, a scan signal supply unit 106, and a data signal supply unit 107.

An image file such, as a stationary image file and dynamic image file, and decoded image data are input from an external apparatus to the separation unit 101. The external apparatus can be a personal computer, a digital camera, a smartphone, and the like. In the example explained in the present exemplary embodiment, an image file is input from the external apparatus. The image file input to the separation unit 101 is referred to hereinbelow as "input image file".

The image file and image data may be also acquired from a recording medium provided inside the display apparatus. The recording medium can be a magnetic disk, an optical disk, a nonvolatile memory, and the like.

FIG. 2A illustrates the data structure of the image file. An image file such as a stationary image file and a dynamic image file is constituted by an image data section and a header section. Image data (for example, RGB values for each pixel) are stored in the image data section. The image data that have been stored in the image data section of the input image file are referred to hereinbelow as "input image data". Header data are stored in the header section. In the present exemplary embodiment, the image data stored in the image data section are assumed to be image data generated by photographing. Further, the header section is assumed to store header data including photographing information relating to photographing conditions at the time the image data stored in the image data section are photographed. The photographing information includes, for example, at least one type of information on an outer light level, ISO sensitivity, shutter speed, aperture value, and photographing mode, during photographing. Thus, the photographing information relating to photographing conditions during photographing is typically added to the photographed image data. Examples of data formats of image file include Open EXR, TIFF (Tagged Image File Format), JPEG (Joint Photographic Experts Group), MPEG (Moving Picture Experts Group), and AVI (Audio Video Interleave).

FIG. 2B is a schematic diagram illustrating the procedure of adding outer light level information (information on the outer light level) as the photographing information.

A stationary image or dynamic image of an object is photographed with a camera 201, and the photographed image data are recorded on a removable medium 202 in the camera 201. A flash memory or a SD card can be used as the removable medium 202.

At the time of object photographing (during photographing or after photographing) with the camera 201, an operator or an assistant measures the outer light level with a meter 204. More specifically, a white board that reflects light is arranged close to the object, and the outer light level is measured by measuring the light reflected by the white board with the meter 204. The measured value of the outer light level is then input to the camera 201 by using a PC (personal computer) 203 connected to the camera 201, and the measured value is recorded on the removable medium 202. The camera 201 and the PC 203 are connected to each other by a USB cable or the like. The measured value is, for example, in cd (candela)/$m^2$ units.

The camera 201 and the PC 203 may be connected to each other by a wire or in a wireless manner.

Through the above-described processing, the image file in which the photographed image data are stored in the image data section and the header data including the measured value of the outer light level are stored in the header section is recorded (generated) in the removable medium 202.

The image file recorded on the removable medium 202 is input to the display apparatus 100 by removing the removable medium 202 from the camera 201 and mounting the removable medium on the display apparatus 100 according to the present exemplary embodiment.

A configuration may be used in which the camera 201 and the display apparatus 100 are connected to each other by an USB cable, and the image file is input from the camera 201 to the display apparatus 100. In this case, a non-removable recording medium may be provided instead of the removable medium 202 in the camera 201. The camera 201 and the display apparatus 100 may be connected to each other by a wire or in a wireless manner.

Where the camera 201 does not have a recording function, a configuration may be used in which the camera 201 and a recorder are connected to each other, the recorder and the PC 203 are connected to each other, and the image file is recorded on a removable medium in the recorder. The recorder is an apparatus having a function of recording the received information (image data and outer light level) on a recording medium.

The separation unit 101 extracts the input image data and photographing information from the input image file, and outputs the extracted input image data and photographing information. In the present exemplary embodiment, the input image data are output upon conversion into image data in a raster format.

FIG. 3 illustrates an example in which image data of n×m pixels is converted into image data in a raster format. Image data in a raster format, as referred to herein, is a series of continuous pixel data rows obtained by scanning an image in regular order from the first line to the m-th line. The separation unit 101 adds a vertical synchronization signal indicating the start of each frame of the image data and a horizontal synchronization signal indicating the start of each line to the input image data and outputs the resultant data.

Figure 4:
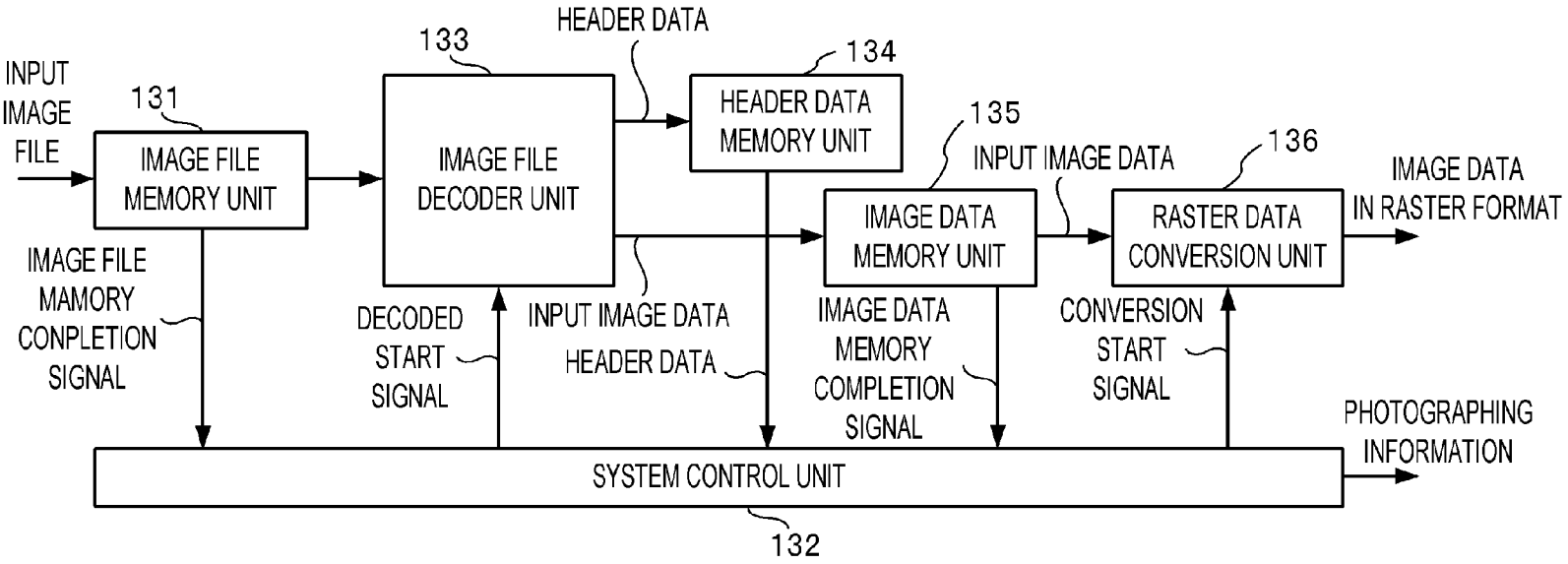
FIG. 4 illustrates an example of the functional configuration of the separation unit according to Embodiment 1.

FIG. 4 is a block diagram illustrating an example of functional configuration of the separation unit 101.

The separation unit 101 has an image file memory unit 131, a system control unit 132, an image file decoder unit 133, a header data memory unit 134, an image data memory unit 135, and a raster data conversion unit 136.

The image file memory unit 131 stores the input image file. Where the storage of the input image file is completed, the image file memory unit 131 transmits an image file memory completion signal to the system control unit 132.

The image file decoder unit 133 acquires the input image file from the image file memory unit 131. Then, the image file decoder unit 133 decodes the acquired input image file in response to the input of a decoding start signal from the system control unit 132. More specifically, the image file decoder unit 133 separates the acquired input image file into a header section and an image data section, extracts header data from the header section, and extracts input image data from the image data section. When the decoding is completed, the image file decoder unit 133 outputs the header data to the header data memory unit 134 and outputs the input image data to the image data memory unit 135. The system control unit 132 outputs the decoding start signal after receiving the image file memory completion signal.

The header data memory unit 134 stores the header data received from the image file decoder unit 133. Where the storage of the header data is completed, the header data memory unit 134 outputs the recorded header data to the system control unit 132.

The image data memory unit 135 stores the input image data received from the image file decoder unit 133. Where the storage of the input image data is completed, the image data memory unit 135 outputs an image data memory completion signal to the system control unit 132.

The system control unit 132 controls the processing start timing of other functional units of the separation unit 101. The system control unit 132 also extracts photographing information from the header data received from the header data memory unit 134, and outputs the extracted photographing information.

A specific example of a method for extracting the photographing information is explained below. In the example explained below, the data format of the image file is the Open EXR format.

FIG. 2C depicts an example of data in the header section in the Open EXR format. The data in the header section are constituted by an attribute name, an attribute type, an attribute size, and an attribute value.

The attribute name represents the type of photographing information. In the case of information indicating the brightness of the outer light during photographing (outer light level), "white brightness" is described in the ASCI code. The attribute type represents the data format of the below-described attribute value. In the case of an integer format, it is described as "int". The attribute size represents the data size (Byte) of the below-described attribute value. FIG. 2C depicts a 4-Byte example. The attribute value represents the value of photographing information (outer light level, ISO sensitivity, shutter spied, aperture value, and photographing mode).

Where the outer light level information is extracted as photographing information from the header section, a data group for which the attribute name is "white brightness" is identified. The attribute value in the identified data group is then extracted as the outer light level information.

The raster data conversion unit 136 acquires the input image data from the image data memory unit 135. The raster data conversion unit 136 then adds a synchronization signal to the acquired input image data in response to the input of a conversion start signal from the system control unit 132, and converts the input image data into image data in the raster format. Where the conversion is completed, the raster data conversion unit 136 outputs the image data in the raster format (input image data with the synchronization signal added thereto). The system control unit 132, outputs the conversion start signal after receiving the image data memory completion signal.

The explanation returns to FIG. 1.

The image processing unit 102 generates display image data from the input image data and outputs the generated display image data. More specifically, the image processing unit 102 performs the predetermined image processing of one or more types with respect to the input image data (input image data in the raster format) that have been received from the separation unit 101, and outputs the image data, which have been subjected to the predetermined image processing, as the display image data. Examples of the predetermined image processing include data format conversion processing, IP conversion processing, expansion-contraction processing, edge enhancement processing, gain adjustment, offset adjustment, color adjustment, and limit processing. Image processing of one type or image processing of a plurality of types may be performed as the predetermined image processing. The data format conversion processing is the processing of converting image data into image data in a data format suitable for displaying on the liquid crystal panel unit 103. For example, the data format conversion processing is the processing of converting image data into bit-number image data corresponding to the liquid crystal panel unit 103. When the data format of the image data corresponding to the liquid crystal panel unit 103 is the integer format which is free from 8-bit encoding, the image data are converted by the data format conversion processing into image data in the integer format which is free from 8-bit encoding.

The backlight module unit 109 is a light-emitting unit having a plurality of light sources of which emission brightness can be controlled individually. The light source has one or more emitting members. For example, a LED, an organic EL element, or a cold-cathode tube can be used as the emitting member. The back surface of the liquid crystal panel unit 103 is irradiated with the light from the backlight module unit 109.

The display unit 115 displays an image on a screen by modulating the light from the backlight module unit 109 on the basis of the display image data.

As indicated in FIG. 1, the display image data output from the image processing unit 102 are input to the display unit 115 via the image extension unit 114. Therefore, in the present exemplary embodiment, the light from the backlight module unit 109 is modulated on the basis of the display image data processed in the image extension unit 114.

The liquid crystal panel unit 103 has a plurality of liquid crystal elements arranged in a matrix configuration, and scanning lines wired in the horizontal direction and data lines wired in the vertical direction are arranged in the liquid crystal elements. A line is selected with the scanning line, and image data on the liquid crystal elements are supplied from the data lines to the liquid crystal elements of the selected line, thereby controlling the transmittance of the liquid crystal elements in the selected line. The transmittance of all of the liquid crystal elements is controlled by performing the abovementioned processing with respect to all of the lines. The light from the backlight module unit 109 that is transmitted by the liquid crystal elements forms an image on the screen.

The panel correction unit 104 performs distortion correction processing with respect to the image data input to the panel correction unit 104 and outputs the image data subjected to the distortion correction processing (panel image data) to the panel control unit 105. The distortion correction processing is the processing of correcting the distortion of the characteristic of the liquid crystal panel unit 103 with respect to the ideal characteristic of the transmittance of the liquid crystal element related to the image data.

The panel correction unit 104 also outputs a synchronization signal of the panel image data (that is, synchronization signal of display image data) to the panel control unit 105.

The panel control unit 105 generates a scan signal and a line data signal on the basis of the panel image data and the synchronization signals thereof (vertical synchronization signal and horizontal synchronization signal) and outputs the generated signals. The scan signal is a signal for successively selecting a line of the liquid crystal panel unit 103 from the top in one-line units, and the line data signal is a signal for supplying image data to each liquid crystal element of the line selected by the scan signal.

The scan signal supply unit 106 successively selects the lines of the liquid crystal panel unit 103 on the basis on the scan signal from the panel control unit 105 and can supply image data to the liquid crystal elements of the selected line.

The data signal supply unit 107 supplies the image data of the liquid crystal elements to each respective liquid crystal element of the line selected by the scan signal supply unit 106, on the basis of the line data signal from the panel control unit 105.

The reference value determination unit 108 acquires the photographing information output from the separation unit 101. The reference value determination unit 108 also determines a target brightness reference value (reference value of the target brightness of the light source) on the basis of the acquired photographing information and outputs the determined target brightness reference value. In the present exemplary embodiment, the outer light level at the time the input image data are photographed is decided from the outer light level information, and the target brightness reference value is determined according to the decided outer light level. More specifically, the target brightness reference value is determined such that the target brightness reference value is higher when the outer light level at the time the input image data are photographed is high than when the outer light level is low. In the present exemplary embodiment the outer light level at the time the input image data are photographed is set as the target brightness reference value. Therefore, where the outer light level at the time the input image data are photographed is Lx (cd/m$^2$), the target brightness reference value is also Lx (cd/m$^2$).

The above-described method for determining the target brightness reference value is not limiting. For example, the target brightness reference value may be also determined according to information of other types such as ISO sensitivity, shutter speed, aperture value, and photographing mode. Further, the target brightness reference value may be also determined according to a combination of various types of information. For example, the target brightness reference value may be also determined according to a combination of ISO sensitivity, shutter speed, aperture value, and photographing mode. It is also possible to estimate the outer light level from the ISO sensitivity, shutter speed, aperture value, and photographing mode and then determine the target brightness reference value according to the estimated value of the outer light level.

The target brightness of the light source is determined by the target emission ratio determination unit 111 and the target brightness determination unit 112 for each light source according to the brightness (luminance) of the display image data (display image data output from the image processing unit 102) in a region on the screen corresponding to the light source.

In the present exemplary embodiment, where a brightness-insufficient light source is present among a plurality of light sources, the target brightness of the light sources (around light source) around the brightness-insufficient light source is adjusted to a value higher than a value corresponding to the brightness of the display image data in a region corresponding to the around light sources. This adjustment will be described hereinbelow in greater detail. The brightness-insufficient light source is a light source for which the target brightness corresponding to the brightness of display image data in the corresponding region is higher than the upper limit value of the emission brightness.

Further, in the present exemplary embodiment, it is assumed that a plurality of divided regions constituting the region of a screen (a plurality of divided regions arranged as a matrix) is set as a plurality of regions corresponding to a plurality of light sources. However, the regions corresponding to the light sources are not limited to such a configuration. For example, a region overlapping the region corresponding to another light source, or a region which is not in contact with the region corresponding to another light source, may be set as the region corresponding to a light source.

Further, in the present exemplary embodiment, it is assumed that a plurality of mutually different divided regions is set as a plurality of regions corresponding to a plurality of light sources, but such a configuration is not limiting. For example, a region same as the region corresponding to another light source may be set as the region corresponding to a light source.

The target emission ratio determination unit 111 determines, for each light source, a target emission ratio, which is a ratio of the target brightness of the light source to the upper limit value of the emission brightness, according to the brightness of the display image data in the region corresponding to the light source. Further, the target emission ratio determination unit 111 performs the adjustment processing of increasing the target emission ratio of the light sources around the brightness-insufficient light source. The target emission ratio determination unit 111 also outputs the target emission ratio of each light source after the adjustment processing. In the present exemplary embodiment, the target brightness is determined by multiplying the target brightness reference value by the target emission ratio. Therefore, by performing the adjustment processing, it is possible to adjust the target brightness of the light sources around the brightness-insufficient light source to a value higher than the value corresponding to the brightness of display image data in the regions corresponding to the around light sources.

Figure 5:
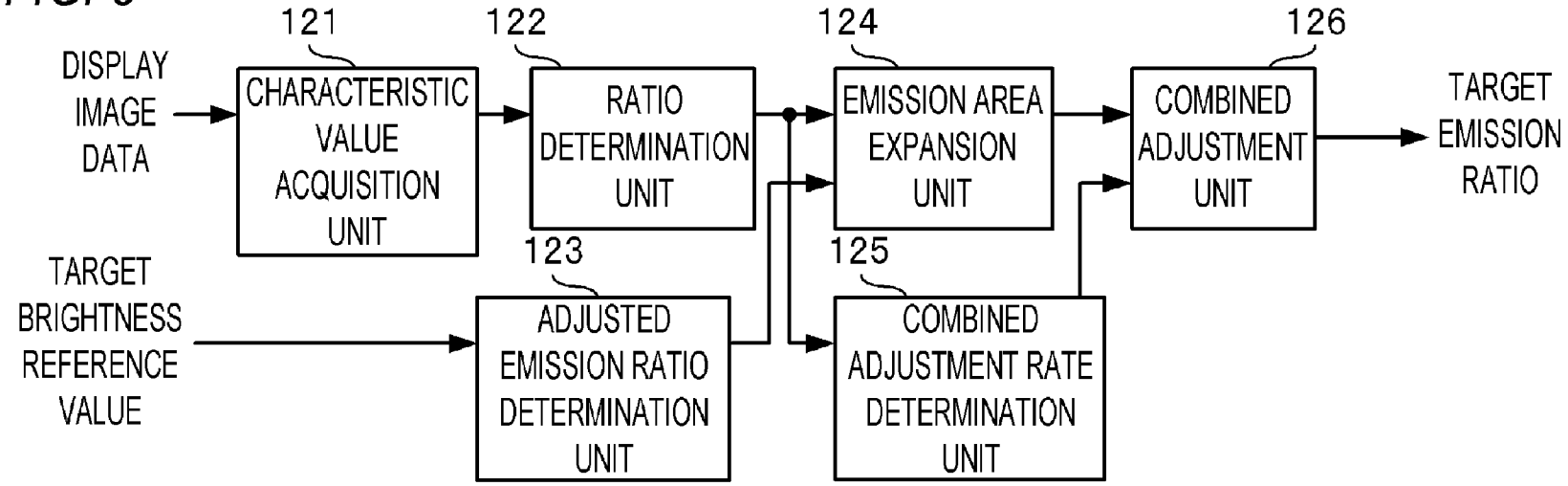
FIG. 5 illustrates an example of the functional configuration of the target emission ratio determination unit according to Embodiment 1.

FIG. 5 is a block diagram illustrating an example of the functional configuration of the target emission ratio determination unit 111.

The target emission ratio determination unit 111 has, for example, a characteristic value acquisition unit 121, a ratio determination unit 122, an adjusted emission ratio determination unit 123, an emission area expansion unit 124, a combined adjustment rate determination unit 125, and a combined adjustment unit 126.

The characteristic value acquisition unit 121 acquires, for each divided region, a characteristic value representing the brightness of image data from the display image data in the divided region (display image data output from the image processing unit 102). The characteristic value acquisition unit 121 also outputs the characteristic value of each divided region. The characteristic value is, for example, a representative value (maximum value, minimum value, most frequent value, medium value, average value, etc.) or a histogram of the pixel values of the display image data in the divided region, or a representative value or a histogram of brightness values of the display image data in the divided region. In the present exemplary embodiment, the maximum value of the pixel values of the display image data in a divided region is acquired as the characteristic value.

The ratio determination unit 122 determines, for each light source, the target emission ratio according to the characteristic value acquired by the characteristic value acquisition unit 121. Then, the ratio determination unit 122 outputs the target emission ratio for each light source. Where the emission brightness of the light source corresponding to the divided region is controlled to a value equal to or greater than a brightness (data brightness) represented by the maximum value of the pixel value of the display image data in the divided region, data brightness of each pixel represented by the display image data in the divided region can be reproduced and displayed. In other words, the abovementioned reproduction and display are possible where a value equal to or greater than a value obtained by dividing the upper limit value of the pixel value by the maximum value of the pixel value of the display image data in the divided region is set as the target emission ratio of the light source corresponding to the divided region. In this case, the ratio determination unit 122 sets a value obtained by dividing the upper limit value of the display value by the characteristic value of the divided region (maximum value of the pixel value of the display image data in the divided region) as the target emission ratio of the light source corresponding to this divided region. For example, where the upper limit value of the pixel value is 255 and the characteristic value (maximum value of the pixel value) is 64, the target emission ratio is 64/255.

Figure 6:
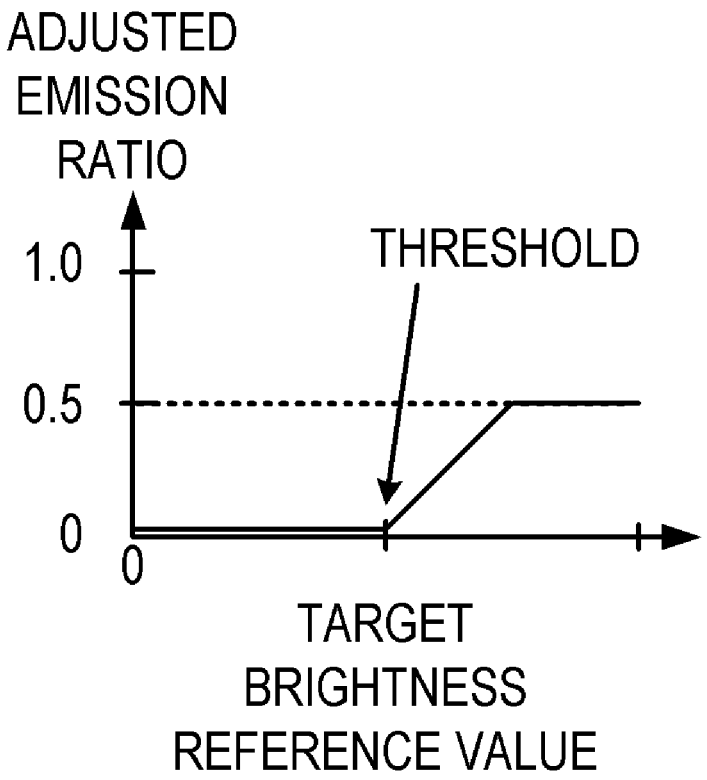
FIG. 6 illustrates an example of the table of the adjusted emission ratio determination unit according to Embodiment 1.

The adjusted emission ratio determination unit 123 determines the adjusted emission ratio, which is the target emission ratio after the adjustment of allocation to the light sources around the brightness-insufficient light source, according to the target brightness reference value output from the reference value determination unit 108. Then, the adjusted emission ratio determination unit 123 outputs the determined adjusted emission ratio. The adjusted emission ratio is determined using information (a function or a table) representing the correspondence relationship of the target brightness reference value and the adjusted emission ratio. In the present exemplary embodiment, the adjusted emission ratio is determined using a look-up table representing the correspondence relationship of the target brightness reference value and the adjusted emission ratio, such as depicted in FIG. 6. The look-up table shown in FIG. 6, outputs 0 as the adjusted emission ratio when the target brightness reference value is equal to or less than a threshold, and the value output as the adjusted emission ratio increases with the increase in the target brightness reference value when the target brightness reference value is larger than the threshold. The threshold is, for example, the upper limit value of the emission brightness of the light source. In the present exemplary embodiment, the upper limit value of the emission brightness of the light source and the threshold are taken as 1000 cd/m$^2$. Further, in the present exemplary embodiment, it is assumed that when the target brightness reference value is 200 cd/m$^2$, 0 is output as the adjusted emission ratio, and when the target brightness reference value is 1500 cd/m$^2$, 0.3 is output as the adjusted emission ratio.

The adjusted emission ratio determination unit 123 outputs the target brightness reference value, which is output from the reference value determination unit 108, to the emission area expansion unit 124.

The emission area expansion unit 124 detects a brightness-insufficient light source by using the target emission ratio output from the ratio determination unit 122 and the target brightness reference value output from the adjusted emission ratio determination unit 123. More specifically, a light source for which a value obtained by multiplying the target emission ratio output from the ratio determination unit 122 by the target brightness reference value output from the adjusted emission ratio determination unit 123 is greater than the upper limit value of the emission brightness is detected as the brightness-insufficient light source.

The emission area expansion unit 124 then performs the adjustment processing of adjusting the target emission ratio output from the ratio determination unit 122. The emission area expansion unit 124 then outputs the target emission ratio after the adjustment processing.

In the adjustment processing, the emission area expansion unit 124 adjusts the target emission ratio of the light sources around the detected brightness-insufficient light source to the adjusted emission ratio output from the adjusted emission ratio determination unit 123. The target emission ratio of all of the light sources present around the brightness-insufficient light source may be adjusted to the adjusted emission ratio. However, where such an adjustment is performed with respect to a light source for which the target emission ratio is higher than the adjusted emission ratio, the emission brightness of the light source becomes lower than the desired emission brightness (a value obtained by multiplying the target emission ratio determined by the ratio determination unit 122 by the target brightness reference value). In the present exemplary embodiment, it is assumed that, among the around light sources, the target emission ratio of the light source for which the target emission ratio is lower than the adjusted emission ratio is adjusted to the adjusted emission ratio, and the target emission ratio of the light source for which the target emission ratio is equal to or greater than the adjusted emission ratio is not adjusted.

FIGS. 7A to 7C illustrate an operation example of the emission area expansion unit 124. FIGS. 7A to 7C illustrate an example in which a total of 30 light sources are provided (6 in the horizontal direction by 5 in the vertical direction), and a total of 30 divided regions are provided (6 in the horizontal direction by 5 in the vertical direction). In FIGS. 7A to 7C, the upper limit value of the emission brightness is 1000 cd/m$^2$. FIG. 7A illustrates the case in which the target brightness reference value is 200 cd/m$^2$ and the case in which the target reference value is 1500 cd/m$^2$. FIGS. 7B and 7C illustrate the case in which the target brightness reference value is 1500 cd/m$^2$. In FIGS. 7A to 7C, a numerical value presented in each divided region is the target emission ratio of the light source (light source disposed in the divided region) corresponding to the divided region. In the present exemplary embodiment, the target emission ratio before the adjustment processing is described as "pre-adjustment ratio" and the target emission ratio after the adjustment processing is described as "post-adjustment ratio".

FIG. 7A illustrates the case in which the pre-adjustment ratio of one light source is 1 and the pre-adjustment ratio of other light sources is 0.

When the target brightness reference value is 200 cd/m$^2$, a brightness-insufficient light source does not appear. Therefore, as mentioned hereinabove, when the target brightness reference value is 200 cd/m$^2$, 0 is set as the adjusted emission ratio. As a result, the adjustment of the target emission ratio is not performed, and the post-adjustment ratio of each light source has the same value as the pre-adjustment ratio.

Meanwhile, where the target brightness reference value is 1500 cd/m$^2$, the light source with a pre-adjustment ratio higher than 0.7 becomes the brightness-insufficient light source. In the example depicted in FIG. 7A, the light source with a pre-adjustment ratio of 1 (the light source corresponding to the divided region represented by "1") becomes the brightness-insufficient light source. Therefore, as mentioned hereinabove, where the target brightness reference value is 1500 cd/m$^2$, 0.3 is set as the adjusted emission ratio. As a result, the target emission ratio of the light sources around the light source for which the pre-adjustment ratio is 1 is adjusted to the adjusted emission ratio of 0.3. In the present exemplary embodiment, a total of eight light sources that are adjacent to the brightness-insufficient light source in the horizontal, vertical, and oblique directions are handled as the light sources around the brightness-insufficient light source. In the example shown in FIG. 7A, the pre-adjustment ratio of the eight light sources is 0, that is, lower than the adjusted emission ratio of 0.3. Therefore, the target emission ratio of the eight light sources is adjusted to the adjusted emission ratio of 0.3. The target emission ratio of the remaining light sources is not adjusted.

FIG. 7B illustrates an example in which the light sources with the pre-adjustment ratio of 0, the light sources with the pre-adjustment ratio of 0.2, the light sources with the pre-adjustment ratio of 0.5, and the light sources with the pre-adjustment ratio of 1 are present. In the example illustrated in FIG. 7B, the processing of adjusting the target emission ratio of the light sources around the light source with the pre-adjustment ratio of 1 to the adjusted emission ratio of 0.3 is performed in the same manner as in the example illustrated by FIG. 7A. The eight light sources adjacent to the light source with the pre-adjustment ratio of 1 include the light sources with the pre-adjustment ratio of 0, the light sources with the pre-adjustment ratio of 0.2, and the light sources with the pre-adjustment ratio of 0.5. Among the eight light sources, the pre-adjustment ratio is lower than the adjusted emission ratio of 0.3 for the light sources with the pre-adjustment ratio or 0 or 0.2. Therefore, the target emission ratio is adjusted to the adjusted emission ratio of 0.3. For the light source with the pre-adjustment ratio of 0.5, among the eight light sources, the pre-adjustment ratio is higher than the adjusted emission ratio of 0.3, and therefore the target emission ratio is not adjusted. The target emission ratio of the remaining light sources is not adjusted.

FIG. 7C illustrates an example in which a plurality (two) of light sources with the pre-adjustment ratio of 1 are present adjacently to each other and the pre-adjustment ratio of other light sources is 0. In this case, the target emission ratio of 10 light sources surrounding the two light sources with the pre-adjustment ratio of 1 (the light sources around at least one of the two light sources with the pre-adjustment ratio of 1) is adjusted to 0.3. The target emission ratio of the remaining light sources is not adjusted.

The combined adjustment rate determination unit 125 determines the combined adjustment rate for each light source on the basis of the target emission ratio for each light source which is output from the ratio determination unit 122. The combined adjustment rate determination unit 125 then outputs the combined adjustment rate for each light source. The combined adjustment rate is the adjustment rate (gain) for adjusting the target emission ratio such that the adequate emission amount, which is neither too large nor too small, is obtained as the emission amount of the backlight module unit 109 when all of the light sources are switched on.

The light from the light sources other than the light source corresponding to a divided region leaks into the divided region. Thus, the brightness of the backlight module unit 109 in a divided region is the brightness of the combined light of the light from the light source corresponding to the divided region and the light from other light sources. Therefore, the target emission ratio of each light source should be determined by taking into account such leak of light. Accordingly, the combined adjustment rate is calculated in the combined adjustment rate determination unit 125 in the following manner.

First, brightness distribution data on a light source, which have been stored in advance, are multiplied for each light source by the target emission ratio of the light source. The brightness distribution data are, for example, data representing the brightness distribution of the light from the light source corresponding to the brightness distribution data (corresponding light source), and are the data normalized such that the peak value of the brightness is 1. In the present exemplary embodiment, the brightness distribution data are assumed to indicate for each light source (divided region) the brightness (normalized brightness) at the position of this light source. Therefore, the ratio for each light source is calculated by multiplying the brightness distribution data by the target emission ratio. The ratio calculated herein is described hereinbelow as "partial brightness ratio".

The combined brightness ratio for the light sources is then calculated by summing up the partial brightness ratios corresponding to each light source.

The combined adjustment rate is then calculated by dividing the target emission ratio by the combined brightness ratio for each light source.

A smaller value of the combined adjustment rate indicates that the emission amount of the corresponding light source is larger and the surplus of the emission amount is large. In other words, a larger value of the combined adjustment rate indicates that the surplus of the emission amount of the corresponding light source is smaller. Therefore, where the target emission ratio of each light source is adjusted on the basis of the maximum value of the combined adjustment rate of each light source, the emission amount of each light source can be adjusted to the lowest necessary limit. The combined adjustment rate determination unit 125 outputs the maximum value of the combined adjustment rate of each light source.

The combined adjustment unit 126 multiplies the target emission ratio of each light source, which is output from the emission area expansion unit 124, by the combined adjustment rate output from the combined adjustment rate determination unit 125 and outputs the product.

The explanation returns to FIG. 1.

The target brightness determination unit 112 determines (calculates), for each light source, the target brightness by multiplying the target emission ratio output from the target emission ratio determination unit 111 (combined adjustment unit 126) by the target brightness reference value output from the reference value determination unit 108. However, when the value obtained by multiplying the target emission ratio by the target brightness reference value exceeds the upper limit value of the emission brightness, the target brightness is limited to a value equal to or lower than the upper limit value of the emission brightness.

The target brightness may be determined using a table representing the correspondence relationship between the target emission ratio and the target brightness reference value.

The emission brightness control unit 110 controls the emission brightness of each light source to the target brightness. More specifically, the emission brightness control unit 110 generates a DC current control signal and a PWM signal according to the target brightness determined by the target brightness determination unit 112 for each light source. Then the emission brightness control unit 110 performs operation control of each light source by the generated DC current control signal and PWM signal. The DC current control signal indicates the value (current value) of the current supplied to the light source, and the PWM signal indicates the length of the supply period of the electric current supplied to the light source. In the present exemplary embodiment, the processing of ON/OFF controlling the supply of electric current to the light sources (ON/OFF control processing) is performed periodically. The PWM signal also indicates the ratio (duty ratio) of the length of the electric current supply period to the length of one period of the ON/OFF control processing.

The emission brightness of the light sources can be also controlled by controlling the value of the voltage supplied to the light sources and the voltage application period.

Figure 8:
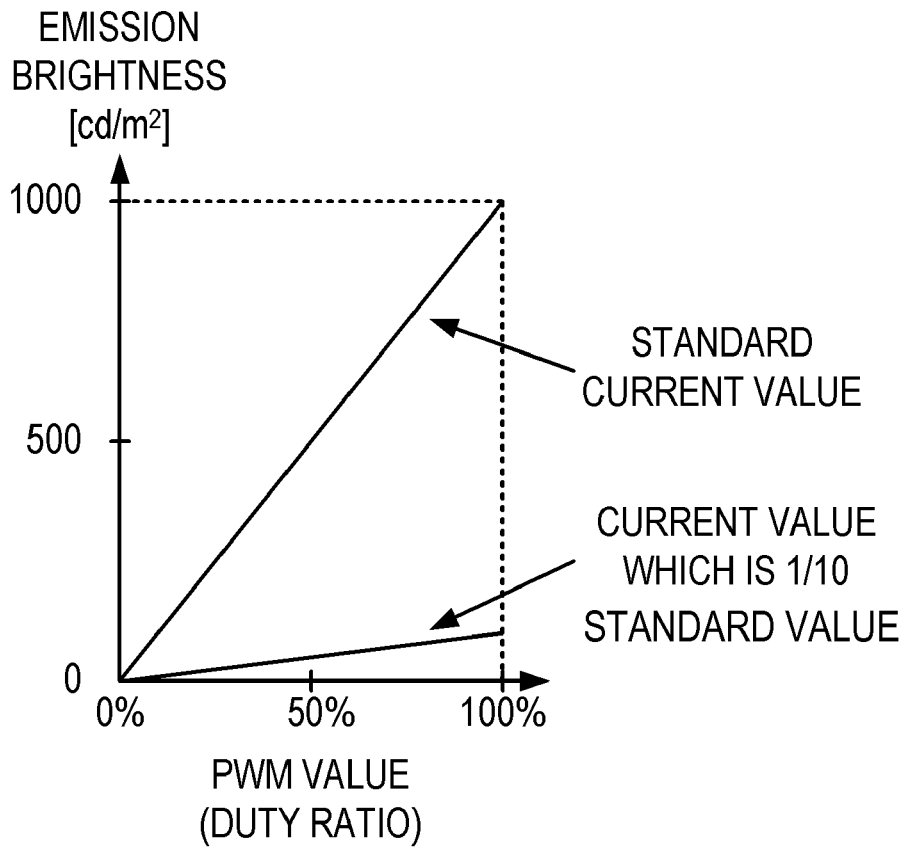
FIG. 8 illustrates an example of the relationship between a PWM value and an emission brightness according to Embodiment 1.

FIG. 8 illustrates by way of example the relationship between the emission brightness (cd/m$^2$) of a light source and the PWM value (duty ratio) in the case in which the light source is driven by a standard current value and a current value which is 1/10 of the standard value. The emission brightness of a light source is determined by the current value driving the light source and the PWM value. In the present exemplary embodiment, the emission brightness control unit 110 determines the PWM value and current value corresponding to the target brightness on the basis of the relationship such as shown in FIG. 8, and generates a DC current control signal indicating the determined current value and a PWM signal indicating the determined PWM value. For example, when the target brightness is 500 cd/m$^2$, the light source may be driven by the standard current value and the PWM value may be taken as 50%. Further, when the target brightness is 20 cd/m$^2$, the light source may be driven by the current value which is 1/10 of the standard value and the PWM value may be taken as 20%. There can be present a plurality of combinations of the current value and PWM value for controlling the emission brightness to the target brightness. In such cases, the current value and PWM value may be determined in consideration of control accuracy and the like. By controlling both the current value and the PWM value, it is possible to ensure finer control of the emission brightness than in the case in which only one value is controlled. Further, by controlling both the current value and the PWM value, it is possible to control the emission brightness in a wider dynamic range than in the case in which only one value is controlled.

The extension rate determination unit 113 determines the extension rate for compensating the variations of the displayed brightness caused by the variations of the emission brightness of the light sources by controlling the aperture ratio (transmittance) of the liquid crystal panel. The extension rate determination unit 113 then outputs the determined extension rate. In the present exemplary embodiment, the extension rate is calculated on the basis of the target emission ratio output from the target emission ratio determination unit 111. Further, in the present exemplary embodiment, the extension rate is calculated for each divided region, and the extension rate for each divided region is output.

A method for calculating the extension rate is explained below in greater detail.

Initially, the combined brightness ratio is calculated from the target emission ratio by the same method as that used by the combined adjustment rate determination unit 125. Then, the inverse of the combined brightness ratio is output as the extension rate. The calculated combined brightness ratio indicates a ratio of the backlight brightness in the case in which the emission brightness of each light source is controlled to a value based on the target emission ratio, which is output from the target emission ratio determination unit 111, to the backlight brightness in the case in which the emission brightness of each light source is controlled to the same value. The backlight brightness is the brightness of the light from the backlight module unit 109. Therefore, by multiplying the image data by the inverse of the combined brightness ratio, it is possible to compensate the variations of the display brightness caused by the variations of the emission brightness of the light sources and to obtain the displayed image with the display brightness same as that in the case in which the emission brightness of each light source has been controlled to the same value.

It is also possible not to calculate the extension rate for each divided region. For example, the extension rate may be calculated for each pixel or for each region different from the divided regions.

The image extension unit 114 multiplies the display image data, which are output from the image processing unit 102, by the extension rate output from the extension rate determination unit 113 and outputs the product to the panel correction unit 104.

Figure 9:
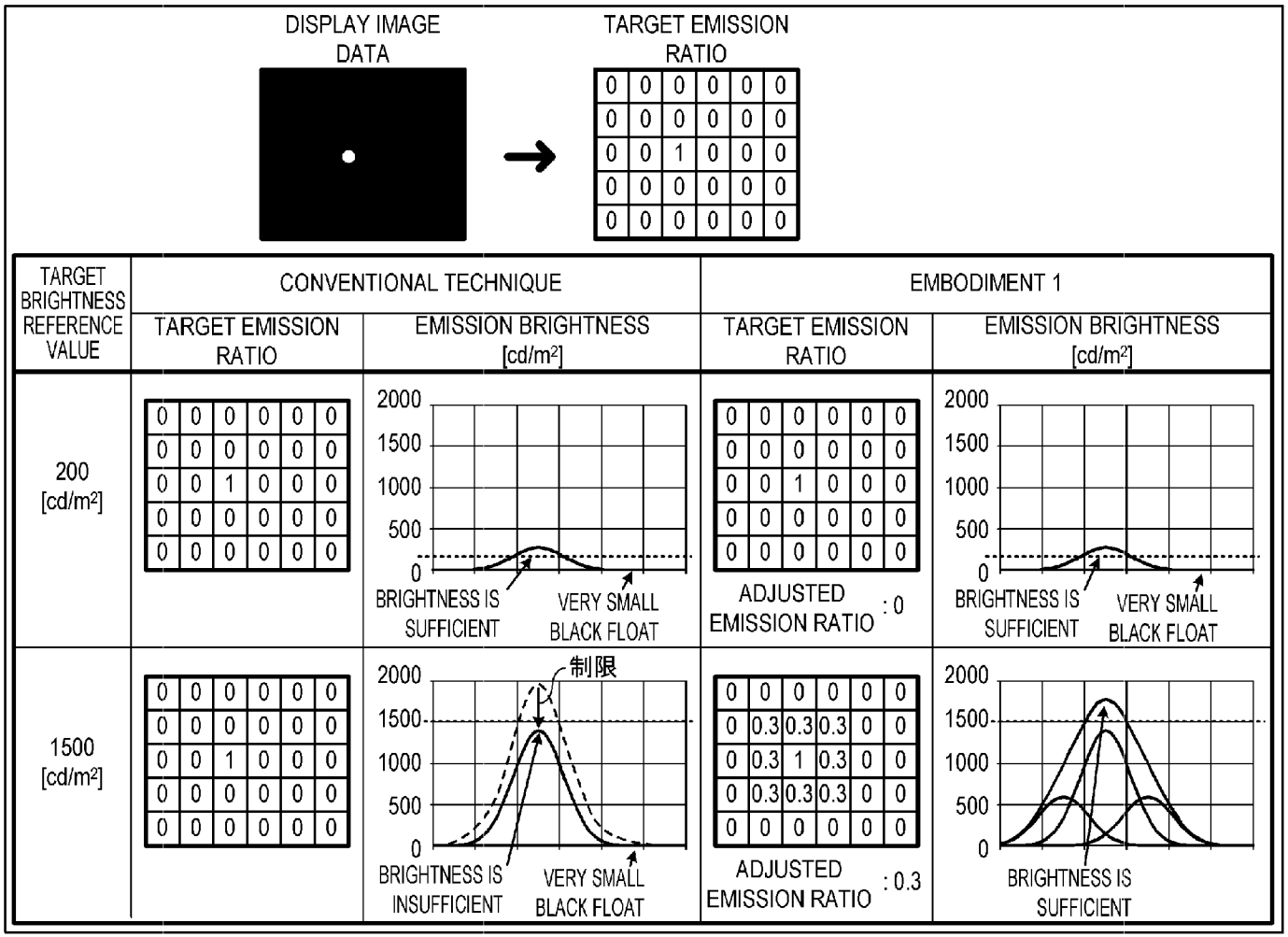
FIG. 9 illustrates an operation example of the display apparatus according to Embodiment 1.

FIG. 9 illustrates the emission brightness control of the present exemplary embodiment. FIG. 9 illustrates an example in which the input image data are data on an image in which a small white object is present on a black background. To simplify the explanation below, it is assumed that the adjustment of the target emission ratio in the combined adjustment unit 126 is not performed.

In the example shown in FIG. 9, the white object is displayed in the divided region which is third from the left and third from the top. Therefore, in the ratio determination unit 122, 1 is set as the target emission ratio of the light source corresponding to the determined divided region which is third from the left and third from the top and is to be determined, and 0 is set as the target emission ratio of the light sources corresponding to other divided regions.

When the target brightness reference value is equal to or less than the upper limit value of 1000 cd/m$^2$ of the emission brightness, the brightness-insufficient light source does not appear. Therefore, the target emission ratio is not adjusted, and the target brightness is determined according to the target emission ratio determined by the ratio determination unit 122. Further, in this case, the display brightness of a white object can be ensured and the black float of the black background can be limited to a maximum limit.

FIG. 9 shows the case in which the target brightness reference value is 200 cd/m$^2$ as an example of the case in which the target brightness reference value is equal to or less that the upper limit value 1000 cd/m$^2$ of the emission brightness. As shown in FIG. 9, the target emission ratio determined by the ratio determination unit 122 becomes the final ratio in both the conventional method and the method of the present exemplary embodiment. The final ratio is the final target emission ratio that is used in determining the target brightness (that is, the target emission ratio output from the target emission ratio determination unit 111). Further, FIG. 9 indicates that when the target emission ratio determined by the ratio determination unit 122 is used as the final ratio, the display brightness of a white object can be ensured and the black float of the black background can be limited to a maximum value.

The brightness-insufficient light source appears in the case in which the target brightness reference value is higher than the upper limit value of 1000 cd/m$^2$_ of the emission brightness.

In FIG. 9, the case in which the target brightness reference value is 1500 cd/m$^2$ is depicted as an example of the case in which the target brightness reference value is higher than the upper limit value of 1000 cd/m$^2$ of the emission brightness.

As shown in FIG. 9, in the conventional method, the target emission ratio determined by the ratio determination unit 122 is the final ratio. However, the target brightness obtained by multiplying the target brightness reference value of 1500 cd/m$^2$ by the final ratio of 1 of the light source corresponding to the divided region representing the white object is 1500 cd/m$^2$ and exceeds the upper limit value of the emission brightness. Therefore, as shown in FIG. 9, the target brightness (emission brightness) of the light source corresponding to the divided region representing the white object is limited to the upper limit value, and therefore the display brightness of the white object cannot be ensured. More specifically, the display brightness of the white object is limited to the upper limit value of the emission brightness.

Meanwhile, in the present exemplary embodiment, when the target brightness reference value is higher than the upper limit value of 1000 cd/m$^2$ of the emission brightness, the target emission ratio of the light sources around the brightness-insufficient light source increases and then the target brightness of the around light sources increases. In the example depicted in FIG. 9, the target emission ratio of the eight light sources around the light source corresponding to the divided region representing the white object is increased from 0 to 0.3. Such control can ensure the display brightness of the white object, as indicated in FIG. 9. As a result of increasing the target brightness (emission brightness) of the light sources around the brightness-insufficient light source, the black float of the black background around the white object somewhat increases. However, since the original display brightness is high, the black float is hardly visible and the obstruction created by the black float (obstruction to visibility of the display image) is small.

As mentioned hereinabove, according to the present exemplary embodiment, since the emission brightness of each light source is controlled according to the brightness of the display image data, the contrast of the display image can be increased. Further, according to the present exemplary embodiment, since the target emission ratio of the light sources around the brightness-insufficient light source increases, the emission brightness of the light sources around the brightness-insufficient light sources increases and the insufficient emission brightness of the brightness-insufficient light source can be compensated. As a result, a display image with a high dynamic range can be obtained. Further, according to the present exemplary embodiment, since the processing of increasing the emission brightness of the light sources around the brightness-insufficient light source is performed when the display brightness is high, a display image with a high dynamic range can be obtained without greatly increasing the obstruction created by the black float. Where the black float is easily noticeable, in other words, where the display brightness is dark, the brightness-insufficient light source does not appear and the emission brightness of each light source is controlled according to the brightness of the display image data. Therefore, the contrast of the display image can be maximized.

Further, in the example explained in the present exemplary embodiment, the target emission ratio of the light sources around the brightness-insufficient light source is increased, but such a feature is not limiting. For example, the target brightness may be determined from the target emission ratio, which is determined according to the display image data, and the target brightness reference value determined on the basis of photographing information. The brightness-insufficient light source may be also decided on the basis of the determined target brightness, and the target brightness determined with respect to the light sources around the brightness-insufficient light source may be increased. Furthermore, the target brightness may be also determined only from the brightness of the display image data, instead of determining the target brightness from the target emission ratio and target brightness reference value.

In the case explained in the present exemplary embodiment, the target brightness reference value is determined on the basis of photographing information, but this method for determining the target brightness reference value is not limiting. For example, the target brightness reference value may be a predetermined fixed value.

In the case explained in the present exemplary embodiment, eight light sources adjacent to the brightness-insufficient light source are used as the light sources around the brightness-insufficient light source, but such a feature is not limiting. The number of light sources around the brightness-insufficient light source may be more or less than eight. For example, two light sources adjacent to the brightness-insufficient light source on the left and right side may be used as the light sources around the brightness-insufficient light source. All of the light sources provided at positions at a distance equal to or less than a predetermined value from the brightness-insufficient light source may be also used as the light sources around the brightness-insufficient light source.

Further, in the case explained in the present exemplary embodiment, the target emission ratio of the light source, among the around light sources, for which the target emission ratio corresponding to the brightness of the display image data in the corresponding region is less than the adjusted emission ratio, is adjusted to the adjusted emission ratio, but such a feature is not limiting. For example, the target brightness of all of the around light sources may be increased. More specifically, the adjusted emission ratio may be added to the target emission ratio of the around light source for all of the around light sources.

Further, in the present exemplary embodiment, the target brightness is limited to a value equal to or less than the upper limit value of the emission brightness when the target brightness exceeds the upper limit value of the emission brightness, but such a feature is not limiting. Where the target brightness exceeds the upper limit value of the emission brightness, the emission brightness may be limited to a value equal to or less than the upper limit value as a result of using the target brightness without limitation.

Further, in the example explained in the present exemplary embodiment, the extension rate is determined using the target emission ratio, but the extension rate may be determined using the target brightness.

<Embodiment 2>

The display apparatus according to Embodiment 2 of the present invention and the control method therefore will be explained below with reference to the appended drawings. In the example explained in Embodiment 1, the target brightness of the light sources (around light sources) around the brightness-insufficient light source is adjusted to a value corresponding to the target brightness reference value. However, when a bright object to be displayed is extremely small and the surroundings thereof are dark, the black float is easily noticeable even when the target brightness reference value is high. Accordingly, in the example described in the present exemplary embodiment, the target brightness after the adjustment of the around light sources is determined on the basis of the area of the bright portion of display image data. More specifically, an example is explained in which the adjusted emission ratio is determined on the basis of the target brightness reference value and the area of the bright portion of the display image data.

The entire configuration of the display apparatus according to the present exemplary embodiment is the same as in Embodiment 1 (FIG. 1). However, in the present exemplary embodiment, the configuration of the target emission ratio determination unit 111 is different from that in Embodiment 1. Other functional units (functional units other than the target emission ratio determination unit 111 in FIG. 1) in the present exemplary embodiment are the same as in Embodiment 1.

Figure 10:
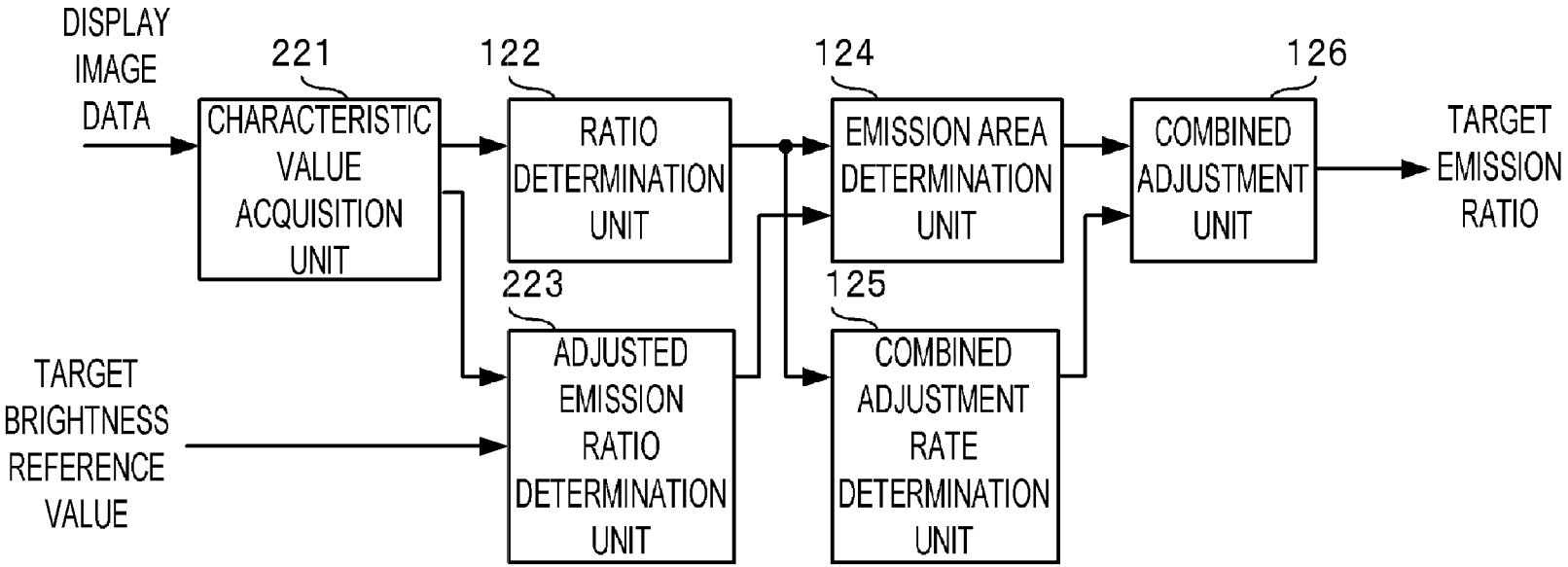
FIG. 10 illustrates an example of the functional configuration of the target emission ratio determination unit according to Embodiment 2.

FIG. 10 is a block diagram illustrating an example of the functional configuration of the target emission ratio determination unit 111 according to the present exemplary embodiment.

The target emission ratio determination unit 111 according to the present exemplary embodiment has, for example, a characteristic value acquisition unit 221, the ratio determination unit 122, an adjusted emission ratio determination unit 223, the emission area expansion unit 124, the combined adjustment rate determination unit 125, and the combined adjustment unit 126.

The operation of the ratio determination unit 122, the emission area expansion unit 124, the combined adjustment rate determination unit 125, and the combined adjustment unit 126 is the same as in Embodiment 1.

The characteristic value acquisition unit 221 acquires a characteristic value from the display image data and outputs the acquired characteristic value in the same manner as the characteristic value acquisition unit 121 of Embodiment 1. The characteristic value acquisition unit 221 performs also size decision processing of deciding, with respect to each region corresponding to a light source (each divided region), the size of a region (bright portion size) constituted by pixels (bright portion pixels) with a pixel value of the display image data equal to or greater than a threshold, in the region. More specifically, the number of bright portion pixels in the divided regions is counted. Then, the ratio of the total number of the bright portion pixels in a divided region to the total number of pixels in the divided region is calculated as a bright portion area ratio for each divided region. The threshold is, for example, a pixel value for which the ratio to the maximum value of the pixel values that can be assumed by the display image data is 80%.

The threshold may be any value, provided that it is possible to decide whether or not a pixel is a bright pixel. For example, the threshold may be determined on the basis of photographing information.

The above-mentioned size decision processing may be also performed by a functional unit other than the characteristic value acquisition unit 221. For example, the display apparatus may have a functional unit (not shown in the figure) for performing the size decision processing.

The adjusted emission ratio determination unit 223 determines, for each divided region, the adjusted emission ratio on the basis of the bright portion area ratio of the divided region and the target brightness reference value.

Figure 11:
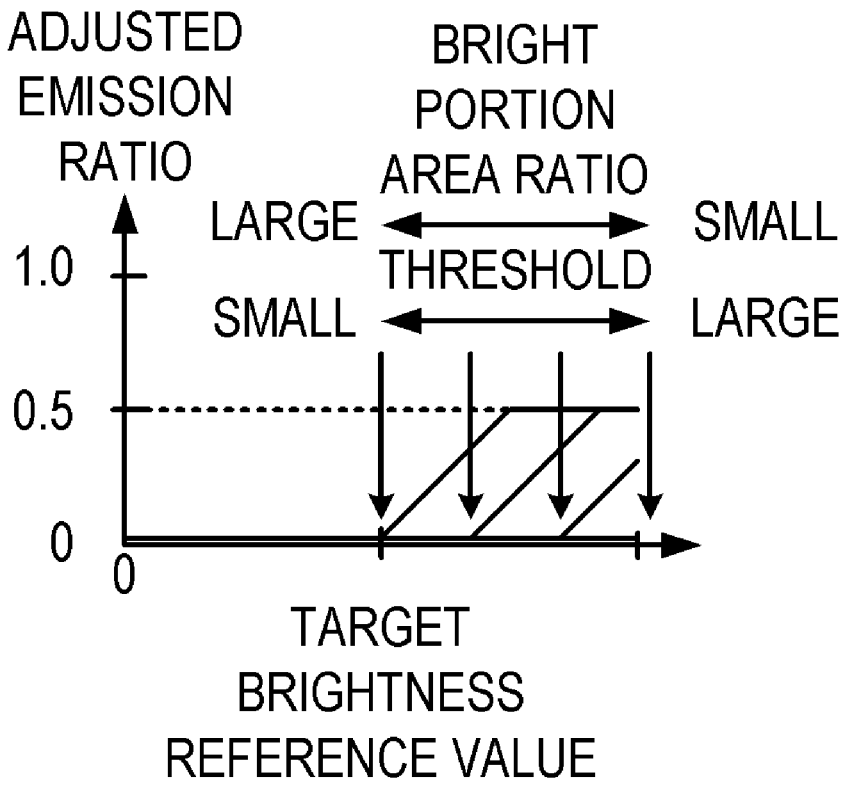
FIG. 11 illustrates an example of the table of the adjusted emission ratio determination unit according to Embodiment 2.

In the present exemplary embodiment, in the same manner as in Embodiment 1, look-up tables are prepared in advance such that where the target brightness reference value is equal to or less than a threshold, 0 is output as the adjusted emission ratio, and where the target brightness reference value is greater than the threshold, a larger value is output as the adjusted emission ratio as the target brightness reference value increases. More specifically, as shown in FIG. 11, a plurality of look-up tables with mutually different thresholds of the target brightness reference value is prepared in advance.

Where the bright portion area ratio is large, the brightness of the display image is high and the black float is hardly noticeable. Accordingly, as shown in FIG. 11, where the bright portion area ratio is large, the adjusted emission ratio determination unit 223 selects and uses a look-up table corresponding to a threshold which is larger than that when the bright portion area ratio is small, thereby determining the adjusted emission ratio which is higher than that when the bright portion area ratio is small.

Meanwhile, where the bright portion area ratio is small, the brightness of the display image is low and the black float is readily noticeable. Accordingly, as shown in FIG. 11, where the bright portion area ratio is small, the adjusted emission ratio determination unit 223 selects and uses a look-up table corresponding to a threshold which is smaller than that when the bright portion area ratio is large, thereby determining the adjusted emission ratio which is lower than that when the bright portion area ratio is large.

For example, a total of four look-up tables may be prepared in which the threshold of the target brightness reference value is larger than the upper limit value of the emission brightness by a factor of 1, 1.2, 1.5, and 2, respectively. Further, when the bright portion area ratio is less than 20%, a look-up table may be selected in which the threshold of the target brightness reference value is the upper limit value of the emission brightness. When the bright portion area ratio is equal to or greater than 20% and less than 30%, a look-up table may be selected in which the threshold of the target brightness reference value is 1.2 times the upper limit value of the emission brightness. When the bright portion area ratio is equal to or greater than 30% and less than 50%, a look-up table may be selected in which the threshold of the target brightness reference value is 1.5 times the upper limit value of the emission brightness. When the bright portion area ratio is equal to or greater than 50%, a look-up table may be selected in which the threshold of the target brightness reference value is 2 times the upper limit value of the emission brightness.

Then, in the emission area expansion unit 124, the target emission ratio of a light source (brightness-insufficient light source or around light source) present in a divided region is adjusted for each divided region by using the adjusted emission ratio of the divided region.

As a result, in the divided region of which the decided small bright portion is size, the target brightness of an around light source is adjusted such that the target brightness of the around light source becomes closer to the value corresponding to the brightness of the display image data in the divided region corresponding to the around light source, than in the divided region of which the decided bright portion size is large.

Figure 12:
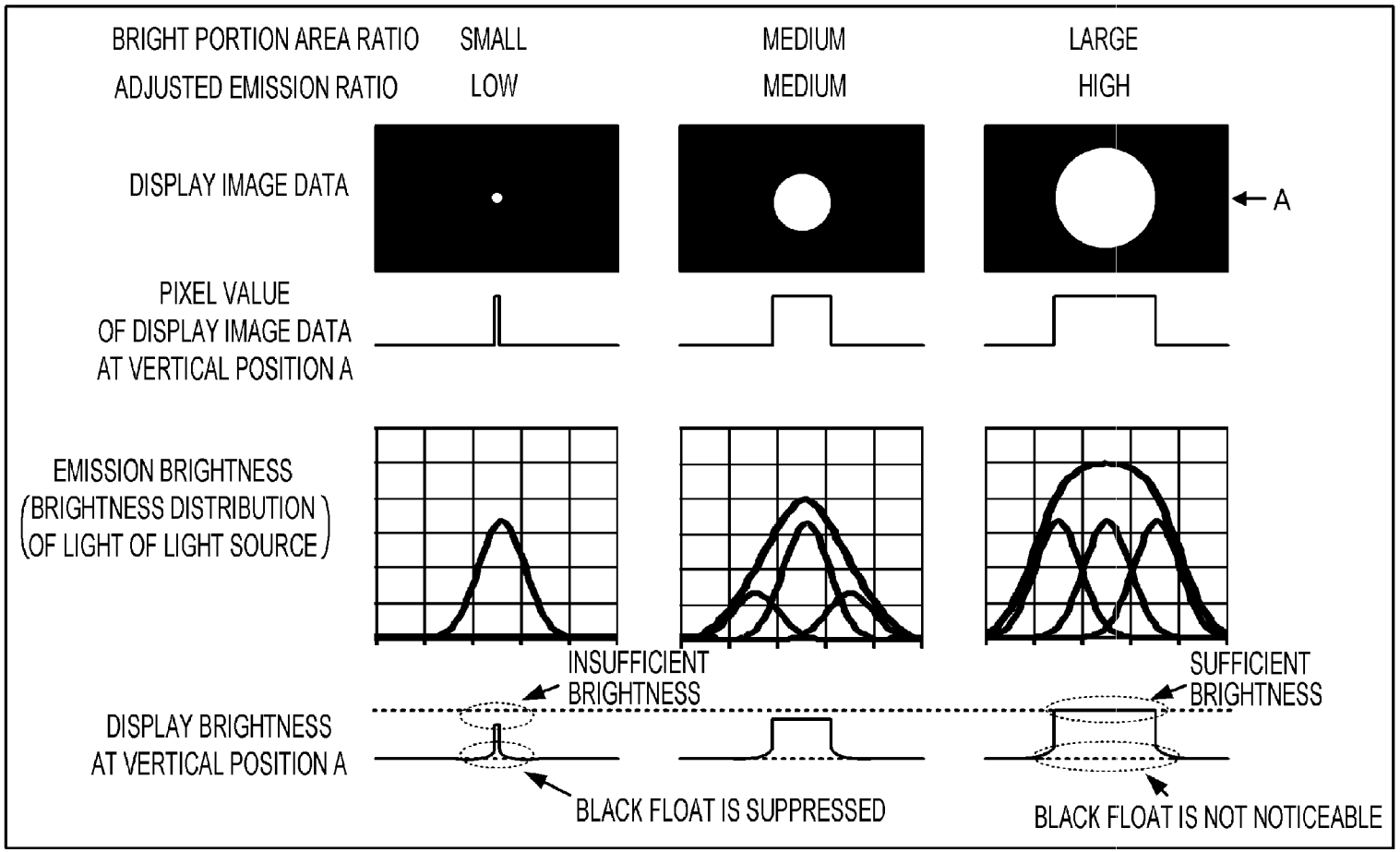
FIG. 12 illustrates an operation example of the display apparatus according to Embodiment 2.

FIG. 12 illustrates the emission brightness control in the present exemplary embodiment. FIG. 12 depicts three examples of emission brightness control corresponding to three images with a "Small", "Medium", and "Large" bright portion area ratio of the divided region corresponding to the around light source. In the example illustrated by FIG. 12, the bright portion area ratio of the divided region corresponding to the brightness-insufficient light source is "Large".

As shown in FIG. 12, according to the present exemplary embodiment, when the bright portion area ratio of the divided region corresponding to the around light source is "Small", the black float is readily noticeable. Therefore, a low value "Low" is set as the adjusted emission ratio of the divided region corresponding to the around light source. The emission brightness of the around light source is thus controlled to a value close to the target brightness corresponding to the brightness of the display image data in the divided region corresponding to the around light source. As a result, the increase in the black float caused by the adjustment of emission brightness (target brightness) can be suppressed, and the increase in the obstruction caused by the black float can be also suppressed.

Meanwhile, as shown in FIG. 12, according to the present exemplary embodiment, when the bright portion area ratio of the divided region corresponding to an around light source is "Large", the black float is hardly noticeable. Therefore, a high value "High" is set as the adjusted emission ratio of the divided region corresponding to the around light source. The emission brightness of the around light source is thus increased. As a result, the display brightness of the brightness-insufficient light source portion can be ensured without making the black float noticeable.

Further, when the bright portion area ratio of the divided region corresponding to the around light source is "Medium", the visibility of the black float is between that when the bright portion area ratio is "Small" and that when the bright portion area ratio is "Large". Therefore, according to the present exemplary embodiment, as the adjusted emission ratio of the divided region corresponding to the around light source, a value "Medium" is set which is between the value set when the bright portion area ratio is "Small" and the value set when the bright portion area ratio is "Large" as shown in FIG. 12. Therefore, the emission brightness of the around light source is controlled to a value between that when the bright portion area ratio is "Small" and that when the bright portion area ratio is "Large". As a result, the increase in the black float can be suppressed and the display brightness of the brightness-insufficient light source portion can be ensured.

As mentioned hereinabove, according to the present exemplary embodiment, the target brightness of the around light sources is adjusted by the adjustment amount based on the bright portion size. As a result, the obstruction created by the black float can be reduced with respect to that in Embodiment 1.

Further, in the example explained in the present exemplary embodiment, the adjustment amount of the target brightness of the around light sources is changed for each divided region, but such a feature is not limiting. For example, the size of the region constituted by pixels for which the pixel value is equal to or greater than the threshold, in the region of the image represented by the display image data, may be decided. Further, where the decided size is small, the target brightness of the around light source may be adjusted such that the target brightness of the around light source is closer to the value corresponding to the brightness of the display image data in the region corresponding to the around light source than when the size is large. Such a configuration also makes it possible to reduce the obstruction created by the black float with respect to that in Embodiment 1.

<Embodiment 3>

The display apparatus according to Embodiment 3 of the present invention and the control method therefore will be explained below with reference to the appended drawings. In the examples explained in Embodiments 1 and 2, the extension rate of the pixel value is calculated on the basis of the target emission ratio obtained by multiplying the combined adjustment rate by the post-adjustment ratio for which the target emission ratio of the around light source is increased. In this case, the display image data can be displayed without saturation even when the target brightness obtained by multiplying the target brightness reference value by the target emission ratio exceeds the upper limit value of the emission brightness and the emission brightness is limited to a value equal to or less than the upper limit value. However, in Embodiments 1 and 2, the display image data in the brightness-insufficient light source portion is not sufficiently extended and a sufficient display brightness cannot be ensured in the brightness-insufficient light source portion.

In the configuration explained in the present exemplary embodiment, the saturation of the display image data is allowed and a sufficient display brightness is ensured in the brightness-insufficient light source portion.

The entire configuration of the display apparatus according to the present exemplary embodiment is the same as in Embodiment 1 (FIG. 1). However, in the present exemplary embodiment, the configuration of the target emission ratio determination unit 111 is different from that in Embodiment 1. Other functional units (functional units other than the target emission ratio determination unit 111 in FIG. 1) in the present exemplary embodiment are the same as in Embodiment 1.

Figure 13:
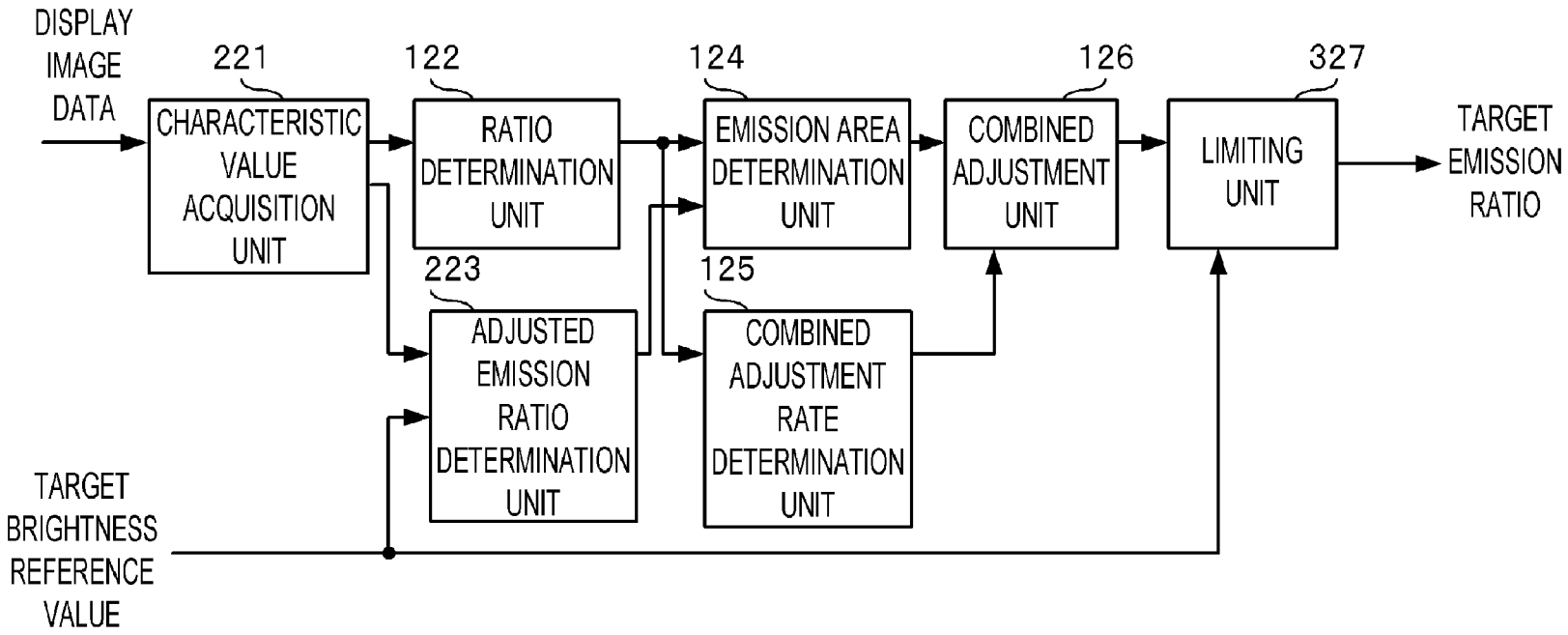
FIG. 13 illustrates an example of the functional configuration of the target emission ratio determination unit according to Embodiment 3.

FIG. 13 is a block diagram illustrating an example of the functional configuration of the target emission ratio determination unit 111 according to the present exemplary embodiment.

The target emission ratio determination unit 111 according to the present exemplary embodiment has, for example, the characteristic value acquisition unit 221, the ratio determination unit 122, the adjusted emission ratio determination unit 223, the emission area expansion unit 124, the combined adjustment rate determination unit 125, the combined adjustment unit 126, and a limiting unit 327.

The operation of the characteristic value acquisition unit 221, the ratio determination unit 122, the adjusted emission ratio determination unit 223, the emission area expansion unit 124, the combined adjustment rate determination unit 125, and the combined adjustment unit 126 is the same as in Embodiment 2.

The limiting unit 327 implements limitation processing with respect to the target emission ratio output from the combined adjustment unit 126, and outputs the target emission ratio subjected to the limitation processing. In the limitation processing, the target emission ratio of a brightness-insufficient light source is limited such that the target brightness of the brightness-insufficient light source becomes a value equal to or less than the upper limit value of the emission brightness. In the present exemplary embodiment, the target emission ratio of the brightness-insufficient light source is limited such that the target emission ratio becomes equal to or less than a value obtained by dividing the upper limit value of the emission brightness by the target brightness reference value. As a result, the target emission ratio of the brightness-insufficient light source is adjusted to the target emission ratio at which the target brightness matches the upper limit value.

By performing such limitation processing, it is possible to calculate in the extension rate determination unit 113 the extension rate that takes into account the fact that the emission brightness of the brightness-insufficient light source is limited to a value equal to or less than the upper limit value. As a result, the display image data are subjected in the image extension unit 114 to compensation processing of compensating the variation of the display brightness caused by the fact that the emission brightness of the brightness-insufficient light source is limited to a value equal to or less than the upper limit value.

FIG. 14 illustrates the image processing performed in the present exemplary embodiment (image processing in the image extension unit 114). In this case, to simplify the explanation, a case is described in which the target emission ratio of a divided region is used as the combined brightness ratio of the divided region for each divided region, and the inverse of the target emission ratio is calculated as an extension ratio for each pixel in the divided region. FIG. 14 illustrates the difference in image processing between Embodiment 2 and the present exemplary embodiment. Further, in the example depicted in FIG. 14, the target brightness reference value is 1000 cd/m$^2$, and the upper limit value of the emission brightness is 700 cd/m$^2$. FIG. 14 also illustrates the image processing in the divided region corresponding to the brightness-insufficient light source (more specifically, the divided region in which the characteristic value is the upper limit value of pixel value).

In Embodiment 2, the target emission ratio of the brightness-insufficient light source is not limited and, therefore, is 1, and the extension ratio is 1 which is the inverse of the target emission ratio. Therefore, the display image data in the brightness-insufficient light source are not extended. However, since the value obtained by multiplying the target brightness reference value by the target emission ratio of the brightness-insufficient light source is 1000 cd/m$^2$, the emission brightness of the brightness-insufficient light source is limited to 700 cd/m$^2$. Therefore, a sufficient display brightness of the brightness-insufficient light source portion cannot be ensured.

Meanwhile, in the present exemplary embodiment, the target emission ratio of the brightness-insufficient light source is limited to 0.7, and the extension rate is 1.4 which is the inverse of the target emission ratio. Therefore, the display image data in the brightness-insufficient light source are extended and the display brightness of the brightness-insufficient light source portion can be increased over that in Embodiment 2. As a result, the display brightness of the brightness-insufficient light source portion can be sufficiently ensured.

When the pixel value after the extension processing exceeds the upper limit value of the pixel values, the pixel value is limited to a value equal to or less than the upper limit value.

As mentioned hereinabove, in the present exemplary embodiment, the compensation processing of compensating the variation of the display brightness caused by the emission brightness of the brightness-insufficient light source being limited to a value equal to or less than the upper limit value of the emission brightness is performed on the display image data. As a result, the display brightness of the brightness-insufficient light source portion can be sufficiently ensured.

In the example explained in the present exemplary embodiment, the limiting unit 327 is added to the configuration of Embodiment 2, but the limiting unit 327 may be also added to the configuration of Embodiment 1.

A method for adjusting (limiting) the target emission ratio of the brightness-insufficient light source is not limited to the above-described method. For example, when a value of "1−[(upper limit value of emission brightness)/(target brightness reference value)]" is defined as an adjusted emission ratio, the target emission ratio after the limitation processing of the brightness-insufficient light source may be calculated by subtracting the adjusted emission ratio from 1.

Further, in the example explained in the present exemplary embodiment, the emission brightness of the brightness-insufficient light source is limited to the upper limit value of the emission brightness, but the emission brightness of the brightness-insufficient light source may be also limited to a value lower than the upper limit value of the emission brightness. In this case, the target emission ratio of the brightness-insufficient light source may be limited to a value lower than a value obtained by dividing the upper limit value of the emission brightness by the target brightness reference value. More specifically, the target emission ratio of the brightness-insufficient light source may be limited such that the target brightness of the brightness-insufficient light source matches the emission brightness after the limiting.

<Embodiment 4>

The display apparatus according to Embodiment 4 of the present invention and the control method therefore will be explained below with reference to the appended drawings. In the examples explained in Embodiments 1 to 3, the target brightness is determined using the target brightness reference value corresponding to photographing information. However, an image file such as Open EXR sometimes stores input image data having an extremely wide dynamic range. Further, the range of pixel values of input image data is sometimes wider than the range corresponding to the display unit 115. The input image data can also include pixel values that cannot be effectively used by the display unit 115. With the configuration explained in the present exemplary embodiment, adequate display can be performed even in such cases.

Figure 15:
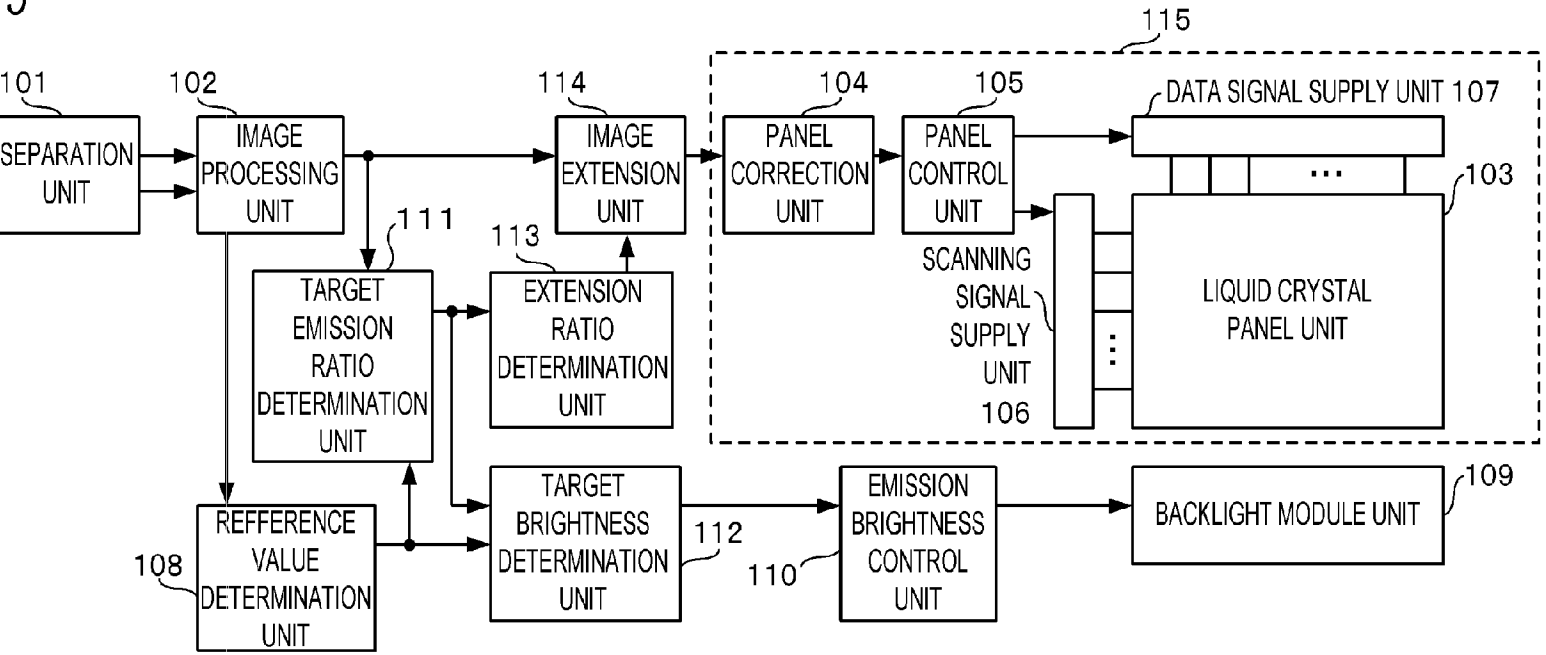
FIG. 15 illustrates an example of the functional configuration of the display apparatus according to Embodiment 4.

FIG. 15 is a block diagram illustrating an example of the functional configuration of the display apparatus according to Embodiment 4.

The display apparatus according to the present exemplary embodiment has the separation unit 101, an image processing unit 402, the display unit 115, the reference value determination unit 108, the backlight module unit 109, the emission brightness control unit 110, the target emission ratio determination unit 111, the target brightness determination unit 112, the extension rate determination unit 113, and the image extension unit 114.

The operation of the separation unit 101, the display unit 115, the reference value determination unit 108, the backlight module unit 109, the emission brightness control unit 110, the target emission ratio determination unit 111, the target brightness determination unit 112, the extension rate determination unit 113, and the image extension unit 114 is the same as in Embodiments 1 to 3.

The image processing unit 402 has a function same as that of the image processing unit 102 of Embodiment 1. When display image data are generated, the image processing unit 402 corrects the image data with a first correction factor by which the maximum value of pixel values is set to a value within a range of pixel values that can be input to the display unit 115. As a result, image data corresponding to the display unit 115 are obtained as the display image data.

Further, the image processing unit 402 corrects photographing information such that the target brightness reference value based on the photographing information becomes a value corrected by the inverse of the first correction factor, and outputs the photographing information after the correction. As a result, the target emission ratio is adjusted using the target brightness reference value corrected by the inverse of the first correction factor and the target brightness is determined using the target brightness reference value. Therefore, the variation of the display brightness caused by the correction of the image data with the first correction factor can be prevented.

Figure 16:
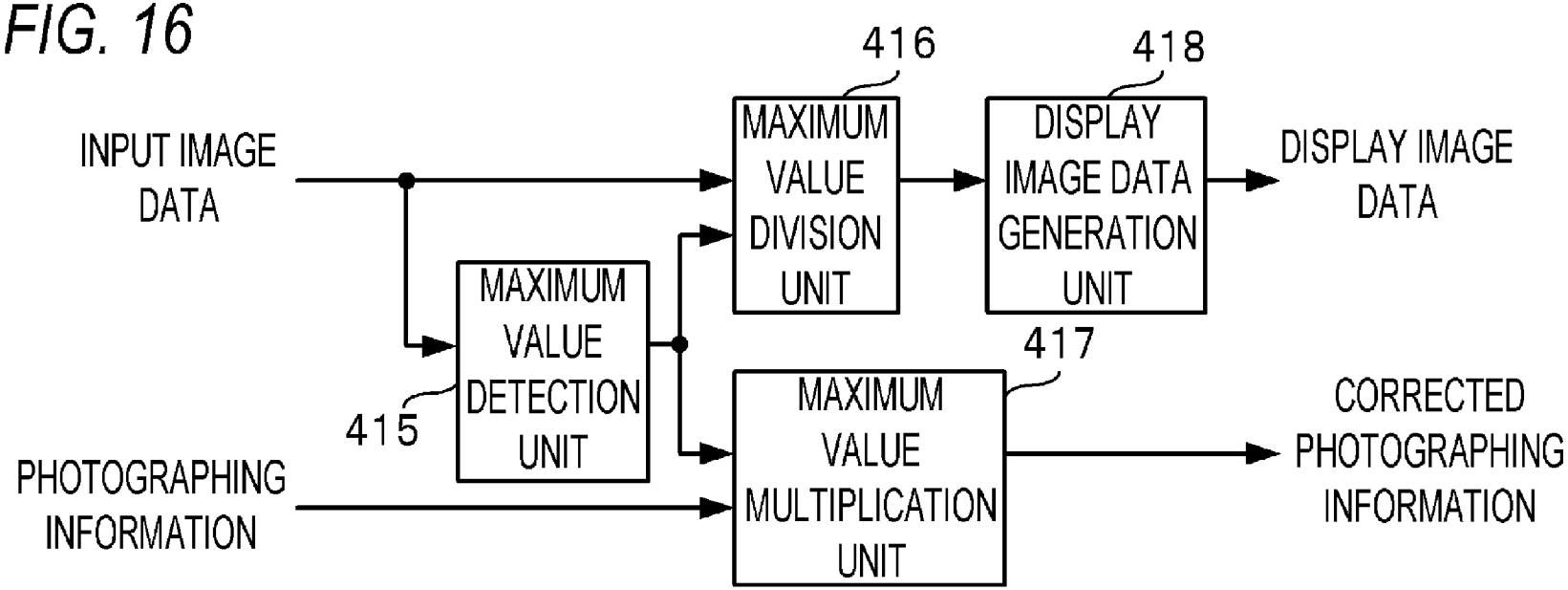
FIG. 16 illustrates an example of the functional configuration of the image processing unit according to Embodiment 4.

FIG. 16 is a block diagram illustrating an example of the functional configuration of the image processing unit 402.

The image processing unit 402 has a maximum value detection unit 415, a maximum value division unit 416, a maximum value multiplication unit 417, and a display image data generation unit 418.

The maximum value detection unit 415 detects the maximum value of pixel values of the input image data from the input image data and outputs the detected pixel value as the maximum pixel value.

The maximum value division unit 416 divides the pixel values of the input image data by the maximum pixel value and outputs the division result (image data with pixel values normalized such that the maximum value of the pixel values is 1) as corrected image data. Thus, in the present exemplary embodiment, the inverse of the maximum pixel value is the first correction factor.

The maximum value multiplication unit 417 corrects the photographing information (for example, the outer light level) by using the first correction factor and outputs the photographing information after the correction as corrected photographing information. In the present exemplary embodiment, a proportional relationship is assumed to be valid between the value of the photographing information and the target brightness reference value determined on the basis of the photographing information. Therefore, the maximum value multiplication unit 417 corrects the photographing information by multiplying the value of the photographing information by the inverse of the first correction factor (that is, the maximum pixel value). The corrected photographing information is input to the reference value determination unit 108, and the target brightness reference value is determined on the basis of the corrected photographing information.

In the maximum value division unit 416, the input image data are divided by the maximum pixel value, and in the maximum value multiplication unit 417, the value of the photographing information is multiplied by the maximum pixel value. Therefore, this processing causes no variations in the display brightness.

The display image data generation unit 418 performs the predetermined image processing with respect to the corrected image data and outputs the image data subjected to the predetermined image processing as display image data.

As indicated hereinabove, according to the present exemplary embodiment, image data corrected by the first correction factor are generated as the display image data. Further, the target emission ratio is adjusted and the target brightness is determined using the target brightness reference value corrected by the inverse of the first correction ratio. As a result, all of the pixel values of the display image data can be effectively used by the display unit 115, and adequate display can be performed. In other words, the degradation of image quality caused by the fact that the display image data include pixel values that cannot be effectively used by the display unit 115 can be suppressed.

Further, in the example explained in the present exemplary embodiment, the first correction ratio is the inverse of the maximum pixel value, but the first correction value is not limited to the inverse of the maximum pixel value. For example, the inverse of the average value of pixel values of the input image data may be calculated as the first correction factor. The first correction factor may be also determined on the basis of the distribution of data brightness of the input image data. The first correction factor may be any value, provided that the maximum value of pixel values can be made a value within the range of pixel values that can be input to the display unit 115. For example, the first correction factor may not be a value determined using the input image data. The first correction factor may be the inverse of the upper limit value of pixel values.

Further, in the example explained in the present exemplary embodiment, the value of photographing information is corrected on the basis of the first correction factor, but such a feature is not limiting. For example, the target brightness reference value determined on the basis of photographing information may be corrected. Further, the display apparatus may have a first correction unit (not shown in the figure) that corrects the photographing information or target brightness reference value.

<Embodiment 5>

The display apparatus according to Embodiment 5 of the present invention and the control method therefore will be explained below with reference to the appended drawings. In the present exemplary embodiment, the configuration is explained that makes it possible to control the reduction degree of the black float or the expansion degree of the dynamic range on the basis of the display image data.

Figure 17:
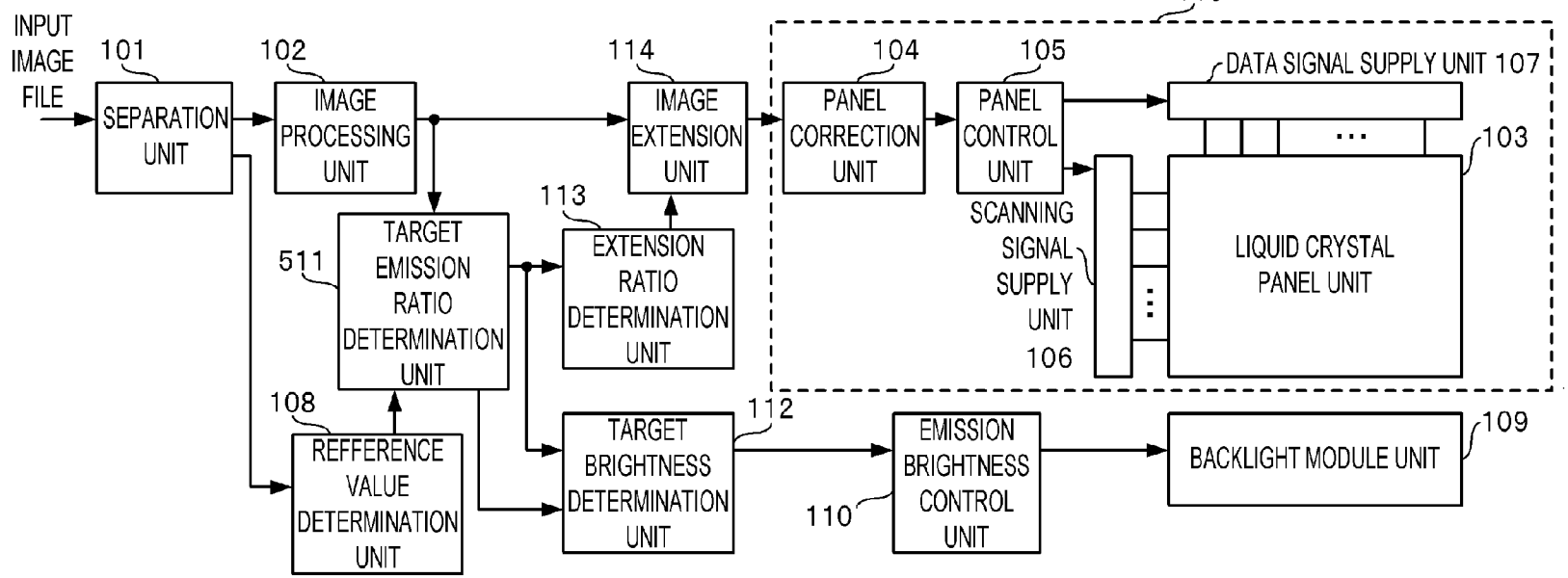
FIG. 17 illustrates an example of the functional configuration of the display apparatus according to Embodiment 5.

FIG. 17 is a block diagram illustrating an example of the functional configuration of the display apparatus according to the present exemplary embodiment.

The display apparatus according to the present exemplary embodiment has, for example, the separation unit 101, the image processing unit 102, the display unit 115, the reference value determination unit 108, the backlight module unit 109, the emission brightness control unit 110, a target emission ratio determination unit 511, the target brightness determination unit 112, the extension rate determination unit 113, and the image extension unit 114.

The operation of the separation unit 101, the image processing unit 102, the display unit 115, the reference value determination unit 108, the backlight module unit 109, the emission brightness control unit 110, the target brightness determination unit 112, the extension rate determination unit 113, and the image extension unit 114 is the same as in Embodiments 1 to 3.

The target emission ratio determination unit 511 corrects the display image data output from the image processing unit 102 with the second correction factor corresponding to the brightness of the display image data, and uses the corrected display image data. Thus, the target emission ratio determination unit 511 determines the target brightness reference value according to the characteristic value acquired from the image data corrected by the second correction factor.

The target brightness reference value output from the reference value determination unit 108 is corrected by the inverse of the second correction factor and output. As a result, the target emission ratio is adjusted using the target brightness reference value corrected by the inverse of the second correction factor, and the target brightness is determined using the target brightness reference value.

Figure 18:
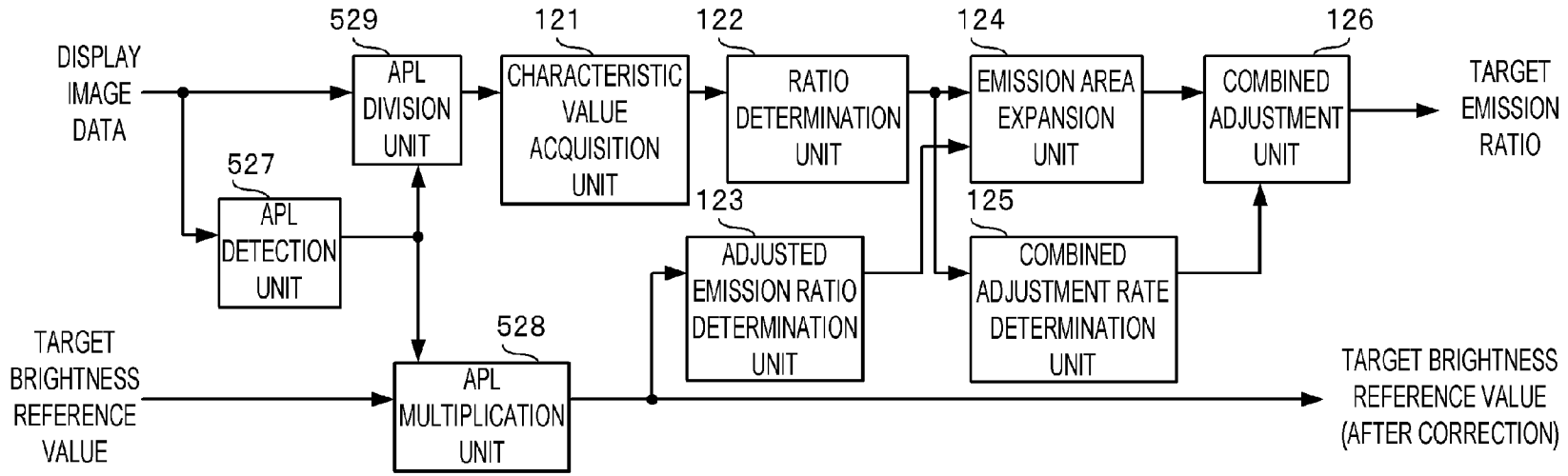
FIG. 18 illustrates an example of the functional configuration of the target emission ratio determination unit according to Embodiment 5.

FIG. 18 is a block diagram illustrating an example of the functional configuration of the target emission ratio determination unit 511.

The target emission ratio determination unit 511 has the characteristic value acquisition unit 121, the ratio determination unit 122, the adjusted emission ratio determination unit 123, the emission area expansion unit 124, the combined adjustment rate determination unit 125, the combined adjustment unit 126, an APL detection unit 527, and APL multiplication unit 528, and an APL division unit 529.

The operation of the characteristic value acquisition unit 121, the ratio determination unit 122, the adjusted emission ratio determination unit 123, the emission area expansion unit 124, the combined adjustment rate determination unit 125, and the combined adjustment unit 126 is the same as in Embodiment 2.

The APL detection unit 527 calculates the average value of pixel values of display image data from the display image data. The APL detection unit 527 normalizes the calculated average value by the maximum value of the pixel values that can be assumed by the display image data (that is, the upper limit value of pixel values). Thus, the APL detection unit 527 divides the calculated average value by the maximum value of the pixel values that can be assumed by the display image data. The APL detection unit 527 then outputs the average value, which has been normalized by the upper limit value of the pixel values, as the APL.

The APL division unit 529 divides each pixel value of the display image data by the APL and outputs the division result to the characteristic value acquisition unit 121. Thus, in the present exemplary embodiment, the inverse of the APL is the second correction factor.

The APL multiplication unit 528 corrects the target brightness reference value by the inverse of the second correction factor and outputs the target brightness reference value after the correction. Thus, the APL multiplication unit 528 multiplies the target brightness reference value by the APL and outputs the target brightness reference value multiplied by the APL. The target brightness reference value after the correction (target brightness reference value corrected by the inverse of the second correction factor) is input to the adjusted emission ratio determination unit 123 and the target brightness determination unit 112. The target emission ratio is then adjusted using the target brightness reference value after the correction. More specifically, the adjusted emission ratio is determined according to the target brightness reference value after the correction. Further, a value obtained by multiplying the target brightness reference value after the correction by the target emission ratio is determined as the target brightness.

As mentioned hereinabove, in the present exemplary embodiment, the display image data are corrected by the second correction factor corresponding to the brightness of the display image data, and the target emission ratio is determined using the image data corrected by the second correction factor. The adjustment of the target emission ratio and the determination of the target brightness are then performed using the target brightness reference value corrected by the inverse of the second correction factor. As a result, the reduction degree of the black float or the expansion degree of the dynamic range can be controlled on the basis of the display image data.

The second correction factor is not limited to the APL. For example, the average value of the pixel values of the display image data (a value before the division by the upper limit value of the pixel values) may be used as the second correction factor. The medium value or the most frequent values of the pixel values of the display image data may be used as the second correction factor. The second correction factor may be any value, provided that this value corresponds to the brightness of the display image data.

In the example explained in the present exemplary embodiment, the target brightness reference value is corrected by the inverse of the second correction factor, but such a feature is not limiting. For example, the photographing information may be corrected such that the target brightness reference value becomes a value corrected by the inverse of the second correction factor. Further, the display apparatus may have a second correction unit (not shown in the figure) that corrects the photographing information or target brightness reference value.

The present exemplary embodiment can be combined with Embodiment 4. When Embodiment 5 and Embodiment 4 are combined, the target emission ratio is determined using the image data corrected by the first correction factor and the second correction factor, and the adjustment of the target emission ratio and the determination of the emission brightness are performed using the target brightness reference value corrected by the inverse of the first correction factor and the inverse of the second correction factor.

<Embodiment 6>

The display apparatus according to Embodiment 6 of the present invention and the control method therefore will be explained below with reference to the appended drawings. For example, in the image format stipulated by SMPTE ST 2065-1:2012 (Academy Color Encoding Specification; ACES), pixel values in an extremely wide range from −65504 to +65504 can be handled as the pixel values proportional to brightness (R values, G values, and B values in the case of RGB image data). In this case, the pixel value 0.18 of image data in the image format stipulated by the ACES corresponds to the brightness of 18% gray card, and the pixel value 1 of image data corresponds to the brightness of a perfect reflecting diffuser. Thus, image data in the image format stipulated by the ACES can include pixel values exceeding the brightness of a perfect reflecting diffuser (referred to hereinbelow as "overwhite").

The processing explained in the present exemplary embodiment relates to the case in which pixel values of overwhite are included in the input image data.

The entire configuration of the display apparatus according to the present exemplary embodiment is the same as in Embodiment 1 (FIG. 1). However, in the present exemplary embodiment, the configurations of the image processing unit 102 and the target emission ratio determination unit 111 are different from those in Embodiment 1. Other functional units in the present exemplary embodiment (functional units other than the image processing unit 102 and the target emission ratio determination unit 111 in FIG. 1) are the same as in Embodiment 1.

In addition to the functions explained in Embodiment 1, the image processing unit 102 of the present exemplary embodiment has a function of converting the ACES image data into display image data matching the characteristics of the display apparatus.

Figure 19:
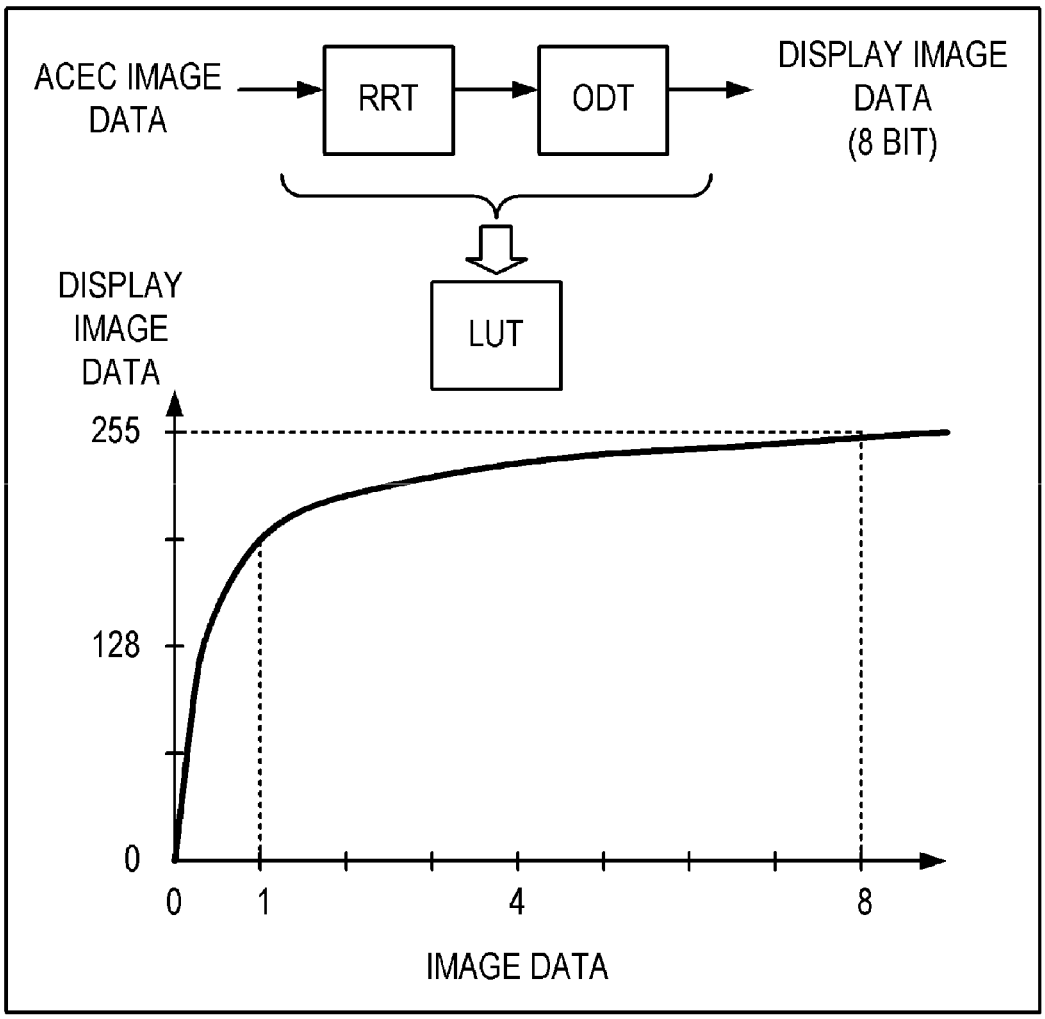
FIG. 19 illustrates an example of the table of the image processing unit according to Embodiment 6.

The ACES image data have an extremely wide dynamic range and cannot be displayed on a display apparatus without being modified. Therefore, the pixel values should be compressed and converted into image data of a dynamic range suitable for the display apparatus. Conversion processing called Reference Rendering Transform (RRT) and Output Device Transform (ODT) are used for converting the ACES image data into image data for display apparatuses. The RRT and ODT are realized using a look-up table (LUT). FIG. 19 shows an example of conversion performed in the image processing unit of the present exemplary embodiment. In this example, image data 1 are converted into display image data 192, and image data 8 are converted into display image data 255.

The photographed image data include a large number of pixels with a pixel value equal to or less than 1 and do not include many pixels with a pixel value greater than 1 (overwhite). Further, the occurrence frequency of overwhite pixels decreases as the pixel value increases. For this reason, a range of pixel values from 0 to about 8, rather than the entire range of pixel values that can be assumed, is most often used in image data. Accordingly, it is assumed that the image processing unit 102 of the present exemplary embodiment converts the range of pixel values of the image data from 0 to 8 into the display image data.

Figure 20:
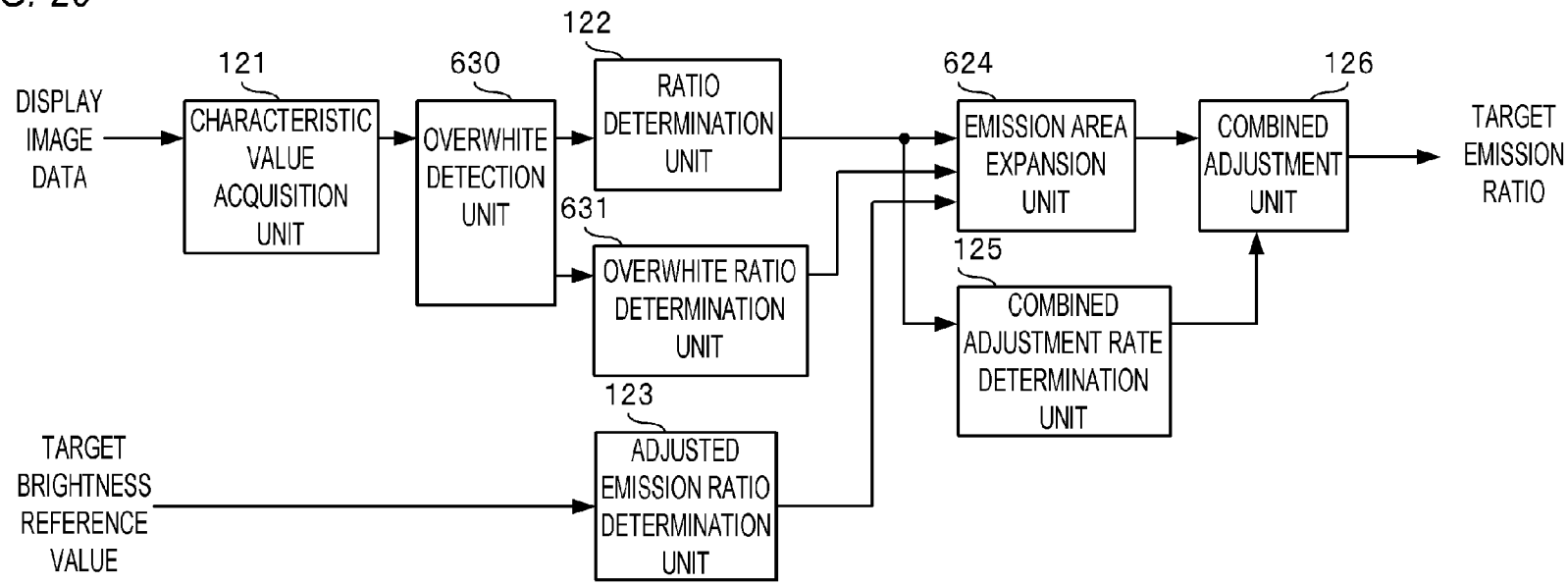
FIG. 20 illustrates an example of the functional configuration of the target emission ratio determination unit according to Embodiment 6.

FIG. 20 is a block diagram illustrating an example of the functional configuration of the target emission ratio determination unit 111 according to the present exemplary embodiment.

The target emission ratio determination unit 111 according to the present exemplary embodiment has, for example, the characteristic value acquisition unit 121, an overwhite detection unit 630, the ratio determination unit 122, an overwhite ratio determination unit 631, the adjusted emission ratio determination unit 123, an emission area expansion unit 624, the combined adjustment rate determination unit 125, and the combined adjustment unit 126.

The operation of the characteristic value acquisition unit 121, the ratio determination unit 122, the adjusted emission ratio determination unit 123, the combined adjustment rate determination unit 125, and the combined adjustment unit 126 is the same as in Embodiment 1.

The overwhite detection unit 630 detects, for each light source, an overwhite from the characteristic value acquired by the characteristic value acquisition unit 121 (maximum value of the pixel values of the display image data in a divided region). Then, the overwhite detection unit 630 outputs the characteristic value limited to or below the overwhite to the ratio determination unit 122, and outputs the characteristic values for which the characteristic value equal to or less than overwhite is taken as 0 to the overwhite ratio determination unit 631. In the present exemplary embodiment, since the image data 1 are converted to 192 in the image processing unit 102, the characteristic values equal to or greater than 192 may be detected as overwhite.

The operation of the overwhite ratio determination unit 631 is the same as that of the ratio determination unit 122. However, since the input characteristic values are only for the divided regions for which the overwhite is detected, the target emission ratio corresponding to the overwhite is output.

The basic operation of the emission area expansion unit 624 of the present exemplary embodiment is the same as that of the emission area expansion unit 124 of Embodiment 1. The emission area expansion unit 624 selects, for each light source, a larger target emission ratio from among the target emission ratio output from the ratio determination unit 122 and the target emission ratio output from the overwhite ratio determination unit 631. The emission area expansion unit 624 then performs the adjustment processing based on the selected target emission ratio and the target brightness reference value output from the adjusted emission ratio determination unit 123 and outputs the target emission ratio after the adjustment processing.

The combined adjustment rate determination unit 125 determines the combined adjustment ratio for each light source as explained in Embodiment 1. However, since the combined adjustment rate determination unit 125 of the present exemplary embodiment determines the combined adjustment rate for each light source on the basis of the target emission ratio output from the ratio determination unit 122, the overwhite divided region produces no effect. Therefore, the adjustment of the target emission ratio in the combined adjustment unit 126 is unaffected by the overwhite divided region.

As mentioned hereinabove, in the present exemplary embodiment, the overwhite is detected and the target emission ratio is determined such that the overwhite can be displayed. Meanwhile, since the combined adjustment rate is determined not to include the overwhite, the adjustment of the target emission ratio is not affected by the overwhite, and the black float of the entire screen does not change according to the overwhite brightness. As a result, with the overwhite, the display can be performed at the necessary brightness as much as possible, and the black float of the entire screen can be stably displayed.

<Embodiment 7>

The display apparatus according to Embodiment 7 of the present invention and the control method therefore will be explained below with reference to the appended drawings. In the example explained in the present exemplary embodiment, the upper limit value of the emission brightness of a light source is determined according to the state of the light source. According to the present exemplary embodiment, the emission area expansion processing (processing of detecting the brightness-insufficient light source and adjusting the target brightness) can be advantageously executed even when the luminous efficiency or emission characteristic of the light source varies according to the temperature of the light source or changes in the light source with time.

Figure 21:
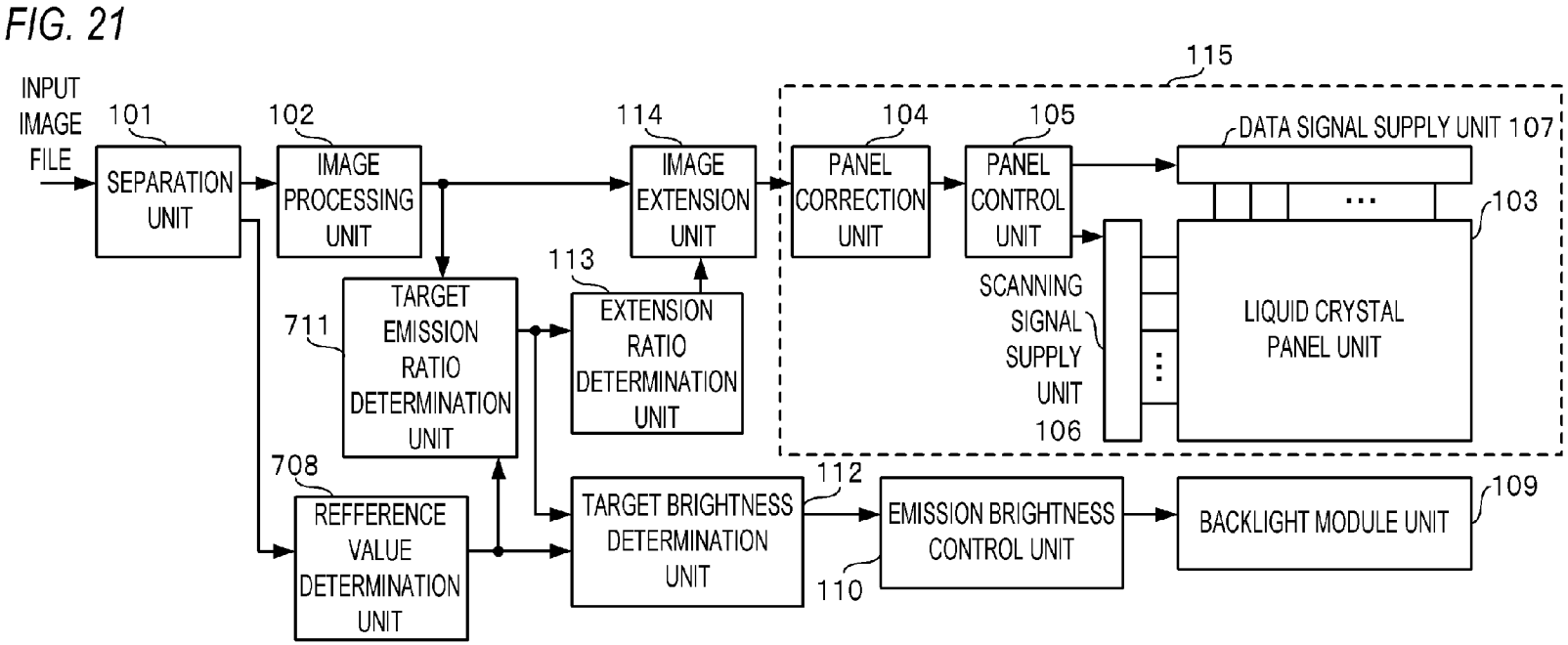
FIG. 21 illustrates an example of the functional configuration of the display apparatus according to Embodiment 7.

FIG. 21 is a block diagram illustrating an example of the functional configuration of the display apparatus according to Embodiment 7.

The display apparatus according to the present exemplary embodiment has, for example, the separation unit 101, the image processing unit 102, the display unit 115, a reference value determination unit 708, the backlight module unit 109, the emission brightness control unit 110, a target emission ratio determination unit 711, the target brightness determination unit 112, the extension rate determination unit 113, and the image extension unit 114.

The operation of the separation unit 101, the image processing unit 102, the display unit 115, the backlight module unit 109, the emission brightness control unit 110, the extension rate determination unit 113, the target brightness determination unit 112, and the image extension unit 114 is the same as in Embodiments 1 to 3.

The reference value determination unit 708 determines the target brightness reference value in the same manner as in Embodiment 1. The reference value determination unit 708 then outputs the determined target brightness reference value to the target brightness determination unit 112.

Further, the reference value determination unit 708 determines the value obtained by dividing the upper limit value (maximum brightness value) of the emission brightness by the target brightness reference value as a maximum brightness ratio. The reference value determination unit 708 then outputs the maximum brightness ratio to the target emission ratio determination unit 711. In this case, the maximum brightness ratio is the emission brightness of a light source when the emission brightness control unit 110 drives the light source at the maximum value of the control signal. The luminous efficiency and emission characteristic of the light source vary depending on the usage conditions such as the temperature of the light source and the cumulative operation time of the light source. Therefore, the maximum brightness value depends on the us age conditions of the light source. The reference value determination unit 708 acquires the maximum brightness value corresponding to the present usage conditions, for example, from predetermined data (table or the like) representing the correspondence relationship between the usage conditions and the maximum brightness value (upper limit determination processing). The cumulative operation time of the light source can be acquired using a measurement apparatus (timer or the like) that measures the operation time of the light source. The temperature of the light source can be acquired using a measurement apparatus (temperature sensor or the like) that measures the temperature of the light source.

The method for acquiring the maximum brightness value is not limited to the above-described method. For example, the maximum brightness value may be also acquired by using a measurement apparatus (brightness sensor or the like) that measures the emission brightness of the light source.

Figure 22:
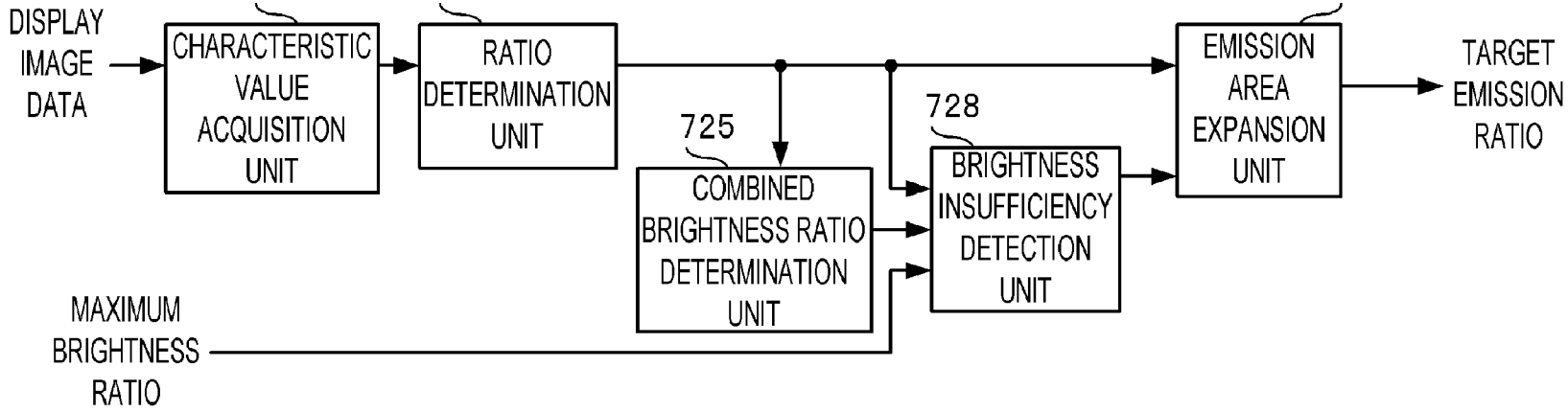
FIG. 22 illustrates an example of the functional configuration of the target emission ratio determination unit according to Embodiment 7.

FIG. 22 is a block diagram illustrating an example of the functional configuration of the target emission ratio determination unit 711. FIGS. 23A to 23I illustrate an operation example of the target emission ratio determination unit 711.

The target emission ratio determination unit 711 has, for example, the characteristic value acquisition unit 121, the ratio determination unit 122, a combined brightness ratio determination unit 725, a brightness insufficiency detection unit 728, and an emission area expansion unit 724.

The operation of the characteristic value acquisition unit 121 and the ratio determination unit 122 is the same as in Embodiment 1.

The combined brightness ratio determination unit 725 determines the combined brightness ratio of each light source by using the target emission ratio determined by the ratio determination unit 122 and the brightness distribution data of the light sources that have been stored in advance, in the same manner as the combined adjustment rate determination unit 125. The combined brightness ratio determination unit 725 outputs the combined brightness ratio of each light source. In Embodiment 1, the brightness distribution data are used that are normalized so that the brightness peak value is 1, but in the present exemplary embodiment, the brightness distribution data are used that are normalized so that the combined brightness ratio of the light sources becomes 1 when the target emission ratio of all of the light sources is taken as 1. FIG. 23A illustrates an example of brightness distribution data corresponding to one divided region (light source of one divided region). In FIG. 23A, the central divided region is the divided region corresponding to the brightness distribution data. As shown in FIG. 23A, the sum total value of the brightness (brightness of a plurality of divided regions) represented by the brightness distribution data corresponding to one divided region is about 1. The peak value of the brightness represented by the brightness distribution data is less than 1. In FIG. 23A, the peak value of the brightness represented by the brightness distribution data is 0.31.

The brightness insufficiency detection unit 728 determines an insufficient brightness ratio on the basis of the target emission ratio output from the ratio determination unit 122, the combined brightness ratio output from the combined brightness ratio determination unit 725, and the maximum brightness ratio output from the reference value determination unit 708. Subsequently, the target emission ratio output from the ratio determination unit 122 is described as the "first target emission ratio". The insufficient brightness ratio means the insufficient amount of the emission brightness that is caused by the emission brightness being limited to the upper limit value when the emission brightness of a light source is controlled according to the first target emission ratio. FIG. 23B depicts an example of the first target emission ratio of each divided region. FIG. 23C depicts an example of the combined brightness ratio of each divided region.

A specific example of processing performed by the brightness insufficiency detection unit 728 is explained below.

Initially, the brightness insufficiency detection unit 728 detects the division region in which the combined brightness ratio is less than the first target emission ratio. Then, the brightness insufficiency detection unit 728 calculates the difference between the combined brightness ratio and the first target emission ratio as a brightness ratio difference for the detected divided region. The brightness insufficiency detection unit 728 then sets the brightness ratio difference of the divided region for which the combined brightness ratio is equal to or greater than the first target emission ratio to 0. FIG. 23D depicts an example of the brightness ratio difference of each divided region.

The brightness insufficiency detection unit 728 then calculates the brightness ratio correction value by dividing the brightness ratio difference by the peak value of brightness distribution data. The brightness ratio correction value is obtained by converting the variation amount of the first target emission ratio into the variation amount of the combined brightness ratio. FIG. 23E depicts an example of the brightness ratio correction value of each divided region.

The brightness insufficiency detection unit 728 then calculates a second target emission ratio by adding the brightness ratio correction value to the first target emission ratio. FIG. 23F depicts an example of the second target emission ratio of each divided region.

The brightness insufficiency detection unit 728 then detects the divided region for which the second target emission ratio is larger than the maximum brightness ratio as a divided region corresponding to the brightness-insufficient light source. Then, the brightness insufficiency detection unit 728 calculates the difference between the second target emission ratio and the maximum brightness ratio as an insufficient brightness ratio for the detected divided region. The brightness insufficiency detection unit 728 then sets 0 as the insufficient brightness ratio of the divided region for which the second target emission ratio is equal to or less than the maximum brightness ratio. FIG. 23G depicts an example of the insufficient brightness ratio of each divided region. In this case, the maximum brightness ratio of the light source corresponding to the divided region in the third row and third column in FIG. 23F is taken as 2.5, which is less than the second target emission ratio (3.10). Further, the maximum brightness ratio of the light source corresponding to the divided region in the third row and fourth column in FIG. 23F is taken as a value equal to or greater than the second target emission ratio (2.05). Therefore, in FIG. 23G, 0.60 is set as the insufficient brightness ratio of the divided region in the third row and third column, and 0 is set as the insufficient brightness ratio of other divided regions.

The brightness insufficiency detection unit 728 then outputs the brightness ratio correction value and insufficient brightness ratio of the divided regions.

The emission area expansion unit 724 determines a third target emission ratio of each divided region (each light source) on the basis of the first target emission ratio output from the ratio determination unit 122 and the brightness ratio correction value and insufficient brightness ratio output from the brightness insufficiency detection unit 728. More specifically, the first target emission ratio of the divided region (brightness-insufficient region) corresponding to the brightness-insufficient light source is corrected to the value same as the maximum brightness ratio. The first target emission ratio of the eight divided region positioned around the brightness-insufficient region is then corrected on the basis of the first target emission ratio, brightness ratio correction value, and insufficient brightness ratio. As a result, the third target emission ratio of each divided region is determined. The emission area expansion unit 724 then outputs the third target emission ratio of each light source. In the present exemplary embodiment, the third target emission ratio is used as the final target emission ratio.

A specific example of the processing performed in the emission area expansion unit 724 will be explained below.

Initially, the emission area expansion unit 724 distributes the insufficient brightness ratio of the brightness-insufficient region to the eight divided regions positioned around the brightness-insufficient region on the basis of the brightness distribution data. In other words, the components of the insufficient brightness ratio of the brightness-insufficient region are allocated, on the basis of the brightness distribution data, as expansion emission ratios to the eight divided regions positioned around the brightness-insufficient region. Where the target emission ratio of one divided region (divided region of interest) is taken as 1 and the target emission ratio of other divided regions is taken as 0 when the brightness distribution data depicted in FIG. 23A are used, the combined brightness ratio of the divided region of interest becomes 0.31. Further, where the target emission ratio of the eight divided regions positioned around the divided region of interest is taken as 1 and the target emission ratio of other divided regions is taken as 0, the combined brightness ratio of the divided region of interest becomes 0.44. Therefore, the expansion emission ratio allocated to the divided regions positioned around the brightness-insufficient region can be calculated by multiplying the insufficient brightness ratio of the brightness-insufficient region by 0.31/0.44. When a plurality of expansion emission ratios is calculated from a plurality of insufficient brightness ratios of a plurality of brightness-insufficient regions with respect to one divided region, the maximum value of the plurality of expansion emission ratios may be allocated to the divided region. Further, the emission area expansion unit 724 allocates 0 as the expansion emission ratio of the divided regions other than the divided regions positioned around the brightness-insufficient region. FIG. 23H depicts an example of the expansion emission ratio of the divided regions.

The emission area expansion unit 724 then calculates the third target emission ratio by adding the larger of the expansion emission ratio and the brightness ratio correction value to the first target emission ratio with respect to the divided regions positioned around the brightness-insufficient region. In other words, a value obtained by adding the larger of the expansion emission ratio and the brightness ratio correction value to the first target emission ratio is set as the third target emission ratio of the divided regions positioned around the brightness-insufficient region. The emission area expansion unit 724 then sets the value same as the maximum brightness ratio as the third target emission ratio of the brightness-insufficient region. Then, the emission area expansion unit 724 sets the value same as the first target emission ratio as the third target emission ratio of the remaining divided regions. FIG. 23I depicts an example of the third target emission ratio of each divided region.

In FIG. 23I, the divided region in the third row and third column is a brightness-insufficient region. Therefore, the value (2.5) same as the maximum brightness value is set as the third target emission ratio of the divided region of the third row and third column.

Further, among the eight divided regions positioned around the divided region in the third row and third column, in the divided region in the third row and fourth column, the expansion emission ratio (0.42) depicted in FIG. 23H is less than the brightness ratio correction value (1.32) depicted in FIG. 23E. Therefore, in FIG. 23I, a value (2.05) obtained by adding the brightness ratio correction value (1.32) to the first target emission ratio (0.7) depicted in FIG. 23B is set as the third target emission ratio of the divided region in the third row and fourth column.

Further, among the eight divided regions positioned around the divided region in the third row and third column, in the seven divided regions other than the divided region in third row and fourth column, the expansion emission ratio (0.42) is greater than the brightness ratio correction value (0). Therefore, in FIG. 23I, a value (0.42) obtained by adding the expansion emission ratio (0.42) to the first target emission ratio (0) is set as the third target emission ratio of the seven divided regions.

Further, in FIG. 23I, the value (0) same as the first target emission ratio is set as the third target emission ratio of the remaining divided regions.

When the calculated third target emission ratio exceeds the maximum brightness ratio, the value of the third target emission ratio may be limited to the value same as the maximum brightness ratio, or the above-described processing may be repeatedly executed until the third target emission ratio of each divided region becomes equal to or less than the maximum brightness ratio. For example, the processing of a total of three types, namely, the processing in the combined brightness ratio determination unit 725, the processing in the brightness insufficiency detection unit 728, and the processing of the emission area expansion unit 724 may be repeatedly executed. Alternatively, the processing of a total of two types, namely, the processing in the brightness insufficiency detection unit 728 and the processing in the emission area expansion unit 724 may be repeatedly executed.

As described hereinabove, in the present exemplary embodiment, the upper limit value of the emission brightness of the light sources is determined according to at least either one of the temperature of the light source and the cumulative operation time of the light source. As a result, the emission area expansion processing can be advantageously executed even when the emission efficiency or emission characteristic of the light sources varies under the effect of the light source temperature or changes in the light sources with time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s).

This application claims the benefit of Japanese Patent Application No. 2013-226979, filed on Oct. 31, 2013, and Japanese Patent Application No. 2014-111628, filed on May 29, 2014, which are hereby incorporated by reference herein in their entirety.

What is claimed is:

1. A display apparatus comprising:

an input unit configured to input display image data and information relating to a target brightness reference value of the display image data;

a light emitting unit having a plurality of light sources of which emission brightness can be controlled individually;

a display unit configured to display an image on a screen by modulating light from the light emitting unit on the basis of the display image data;

a determination unit configured to determine a target brightness for each light source of the plurality of light sources on the basis of a brightness of the display image data in a region corresponding to the respective light source; and a control unit configured to control the emission brightness of each light source based on the target brightness, wherein in a case where a brightness-insufficient light source, for which the target brightness corresponding to the brightness of the display image data in the corresponding region exceeds an upper limit value of the emission brightness, is present among the plurality of light sources, the determination unit adjusts, based on the target brightness reference value, the target brightness of light sources around the brightness-insufficient light source, to a value higher than a value corresponding to the brightness of the display image data in regions corresponding to the light sources around the brightness-insufficient light source.

2. The display apparatus according to claim 1, wherein the determination unit determines, for each light source, a target emission ratio, which is a ratio of a target brightness of the light source to the upper limit value of the emission brightness, on the basis of a brightness of the display image data in a region corresponding to the light source, and wherein, in a case where a brightness-insufficient light source, for which the target brightness corresponding to the brightness of the display image data in the corresponding region exceeds the upper limit value of the emission brightness, is present among the plurality of light sources, the determination unit increases the target emission ratio of the light sources around the brightness-insufficient light source based on the target brightness reference value.

3. The display apparatus according to claim 2, further comprising:

a generation unit configured to generate the display image data from input image data; and a reference value determination unit configured to acquire photographing information relating to photographing conditions at the time the input image data are photographed, and determining the target brightness reference value, on the basis of the photographing information.

4. The display apparatus according to claim 3, wherein the photographing information includes information indicating at least one among an outer light level, an ISO sensitivity, a shutter speed, an aperture value, and a photographing mode, at the time the input image data are photographed, and wherein the reference value determination unit determines the target brightness reference value according to at least one of the outer light level at the time the input image data are photographed, ISO sensitivity, shutter speed, aperture value, and photographing mode.

5. The display apparatus according to claim 3, wherein the photographing information includes information indicating an outer light level at the time the input image data are photographed, and wherein the reference value determination unit determines the target brightness reference value such that the target brightness reference value is higher when the outer light level at the time the input image data are photographed is high than when the outer light level is low.

6. The display apparatus according to claim 2, wherein the determination unit adjusts the target emission ratio of the light sources around the brightness-insufficient light source to a value corresponding to the target brightness reference value.

7. The display apparatus according to claim 2, wherein the determination unit adjusts the target emission ratio of a light source among the light sources around the brightness-insufficient light source, for which the target emission ratio corresponding to the brightness of the display image data in the corresponding region is lower than a value corresponding to the target brightness reference value, to the value corresponding to the target brightness reference value.

8. The display apparatus according to claim 1, further comprising:

a generation unit configured to generate the display image data by subjecting input image data to image processing of at least one type including image processing of correcting image data with a first correction factor by which a maximum value of pixel values is set to a value within a range of pixel values that can be input to the display unit; and a first correction unit configured to correct the target brightness reference value by an inverse of the first correction factor, wherein the determination unit determines the target brightness on the basis of the target brightness reference value corrected by the inverse of the first correction factor.

9. The display apparatus according to claim 1, wherein the determination unit corrects the display image data with a second correction factor corresponding to the brightness of the display image data, and uses the corrected display image data, wherein the display apparatus has a second correction unit configured to correct a target brightness reference value with an inverse of the second correction factor, and wherein the determination unit determines the target brightness on the basis the target brightness reference value corrected by the inverse of the second correction factor.

10. The display apparatus according to claim 1, wherein the light sources around the brightness-insufficient light source include a light source adjacent to the brightness-insufficient light source in a horizontal direction, a vertical direction, and an oblique direction.

11. The display apparatus according to claim 1, further comprising a decision unit configured to decide a size of a region constituted by pixels with a pixel value equal to or greater than a threshold, in an image represented by the display image data, wherein the determination unit adjusts the target brightness of the light sources around the brightness-insufficient light source such that, in a case that the size decided by the decision unit is smaller than a predetermined size, (a) the target brightness of the light sources around the brightness-insufficient light source is closer to (b) a value corresponding to the brightness of the display image data in the regions corresponding to the light sources around the brightness-insufficient light source than it would be in a case that the size decided by the decision unit is larger than the predetermined size.

12. The display apparatus according to claim 1, further comprising a decision unit configured to decide, for each region corresponding to a light source of the plurality of light sources, a size of a region constituted by pixels with a pixel value of the display image data equal to or greater than a threshold, in the region, wherein the determination unit adjusts the target brightness of the light sources around the brightness-insufficient light source such that, in a region of which the size decided by the decision unit is smaller than a predetermined size, (a) the target brightness of the light sources around the brightness-insufficient light source is closer to (b) a value corresponding to the brightness of the display image data in the regions corresponding to the light sources around the brightness-insufficient light source than in a region of which the size decided by the decision unit is larger than the predetermined size.

13. The display apparatus according to claim 1, wherein the emission brightness of the brightness-insufficient light source is limited to a value equal to or less than the upper limit value of the emission brightness, and wherein the display apparatus has a compensation unit configured to perform, on the display image data, compensation processing of compensating a variation of the display brightness, which is caused by the emission brightness of the brightness-insufficient light source being limited to the value equal to or less than the upper limit value of the emission brightness, when the display image data are input to the display unit.

14. The display apparatus according to claim 1, further comprising an upper limit determination unit configured to determine the upper limit value of the emission brightness of the light source according to at least either of a temperature and a cumulative operation time, of the light source.

15. A control method for a display apparatus including (a) an input unit configured to input display image data and information relating to a target brightness reference value of the display image data, (b) a light emitting unit having a plurality of light sources of which emission brightness can be controlled individually, and (c) a display unit configured to display an image on a screen by modulating light from the light emitting unit on the basis of the display image data, the control method comprising:

determining a target brightness for each light source of the plurality of light sources on the basis of a brightness of the display image data in a region corresponding to the respective light source; and controlling the emission brightness of each light source based on the target brightness, wherein, in determining the target brightness, in a case where a brightness-insufficient light source, for which the target brightness corresponding to the brightness of the display image data in the corresponding region exceeds an upper limit value of the emission brightness, is present among the plurality of light sources, the target brightness of light sources around the brightness-insufficient light source is adjusted, based on the target brightness reference value, to a value higher than a value corresponding to the brightness of the display image data in regions corresponding to the light sources around the brightness-insufficient light source.

16. A non-transitory computer-readable medium that stores a program, wherein the program causes a computer to execute a control method for a display apparatus including (a) an input unit configured to input display image data and information relating to a target brightness reference value of the display image data, (b) a light emitting unit having a plurality of light sources of which emission brightness can be controlled individually, and (c) a display unit configured to display an image on a screen by modulating light from the light emitting unit on the basis of the display image data, the control method comprising:

determining a target brightness for each light source of the plurality of light sources on the basis of a brightness of the display image data in a region corresponding to the respective light source; and controlling the emission brightness of each light source based on the target brightness, and wherein, in determining the target brightness, in a case where a brightness-insufficient light source, for which the target brightness corresponding to the brightness of the display image data in the corresponding region exceeds an upper limit value of the emission brightness, is present among the plurality of light sources, the target brightness of light sources around the brightness-insufficient light source is adjusted, based on the target brightness reference value, to a value higher than a value corresponding to the brightness of the display image data in regions corresponding to the light sources around the brightness-insufficient light source.

* * * * *